US007353969B2

(12) United States Patent
McHutchinson

(10) Patent No.: US 7,353,969 B2
(45) Date of Patent: Apr. 8, 2008

(54) TAMPER AND CHILD PROOF TABLET DISPENSER WITH EJECTION MEANS

(75) Inventor: Roy Neil McHutchinson, Lower Chittering (AU)

(73) Assignee: IN VIVO Systems Limited, Norwich, Norfolk (GB)

( * ) Notice: Subject to any disclaimer, the term of this patent is extended or adjusted under 35 U.S.C. 154(b) by 323 days.

(21) Appl. No.: 10/344,471

(22) PCT Filed: Aug. 10, 2001

(86) PCT No.: PCT/AU01/00982

§ 371 (c)(1),
(2), (4) Date: Jun. 5, 2003

(87) PCT Pub. No.: WO02/14181

PCT Pub. Date: Feb. 21, 2002

(65) Prior Publication Data

US 2004/0074917 A1 Apr. 22, 2004

(51) Int. Cl.
*G07F 11/00* (2006.01)

(52) U.S. Cl. ..... 221/88; 221/89; 221/25; 221/302

(58) Field of Classification Search ..... 221/25, 221/87, 88, 302; 206/531, 532, 539
See application file for complete search history.

(56) References Cited

U.S. PATENT DOCUMENTS 4,069,942 A 1/1978 Marshall et al.
4,252,248 A * 2/1981 Obrist et al. ..... 220/270
4,526,293 A 7/1985 Kramer
4,555,044 A 11/1985 Pearo
4,735,318 A * 4/1988 Keffeler ..... 206/532
4,787,526 A * 11/1988 Pehr ..... 215/216
4,858,207 A * 8/1989 Buchner ..... 368/10
5,040,695 A * 8/1991 Adams et al. ..... 220/270
5,082,137 A * 1/1992 Weinstein ..... 220/345.3
5,275,291 A * 1/1994 Sledge ..... 206/531
5,489,025 A * 2/1996 Romick ..... 206/531
5,878,887 A * 3/1999 Parker et al. ..... 206/528
5,975,347 A * 11/1999 Lambelet et al. ..... 221/25
6,062,420 A * 5/2000 Krouwel et al. ..... 221/5

(Continued)

FOREIGN PATENT DOCUMENTS

AU 727322 1/1999

(Continued)

*Primary Examiner*—Gene O. Crawford
*Assistant Examiner*—Timothy Waggoner
(74) *Attorney, Agent, or Firm*—Merchant & Gould P.C.

(57) ABSTRACT

Tamper and child proof dispenser for a solid dosage product such as tablets and capsules that may be contained in a blister sheet. Dispenser comprises a dispensing assembly (3) for holding and dispensing the product, a slidably or hingedly connected outercover (1) for covering the assembly to prevent access to the product, and tamper indication means (7) of an elongate removable tag for indicating a prior displacement of the outer cover. The dispenser has an external child proof button (9) supported on a tongue (10). The dispensing assembly has an ejection means of a slide actuation mechanism (57) including an actuation arm (59) upon which is mounted a slidable rider member (61) with an abutment to engage and eject the solid dosage product. The outer cover has four separable portions (67) which are individually removed to enable a particular actuation mechanism (57) to be moved for dispensing a product.

72 Claims, 15 Drawing Sheets

U.S. PATENT DOCUMENTS

| | | | | |
|---|---|---|---|---|
| 6,149,029 | A * | 11/2000 | de Meyer et al. | 221/25 |
| 6,662,081 | B1 * | 12/2003 | Jacober et al. | 700/242 |
| 6,726,053 | B1 * | 4/2004 | Harrold | 221/25 |
| 6,871,753 | B2 * | 3/2005 | McHutchinson | 220/296 |
| 6,896,137 | B2 * | 5/2005 | McHutchinson | 206/528 |

FOREIGN PATENT DOCUMENTS

| | | |
|---|---|---|
| WO | WO 94/14682 | 7/1994 |
| WO | WO94/14682 | 7/1994 |
| WO | WO99/01101 | 1/1999 |

* cited by examiner

SECTION A - A

SECTION L - L

SECTION K - K

SECTION J - J

TAMPER AND CHILD PROOF TABLET DISPENSER WITH EJECTION MEANS

The present invention is generally directed to packaging and dispensing systems, and in particular to tamper proof dispensers suitable for products such as medicinal tablets or capsules. Although the present invention will be described with respect to such products, it is to be appreciated the invention is also applicable for dispensing other types of products.

Products of the above mentioned type are commonly sold in cardboard cartons, with the tablets or capsules individually sealed in a bubble wrapped sheet. This form of packaging provides a long shelf life for the product as they are individually placed in an air tight seal. Furthermore, this type of packaging provides for more hygienic storage of the product. These cartons can be covered by heat wrapped plastic sheeting to afford a limited degree of tamper prevention by preventing the opening of the carton to gain access to the contents without tearing of the plastic wrapping. The tearing of the wrapping provides a visual indication that the packaging has been opened. This type of wrapping does not however prevent a more malicious form of tampering where the products are dosed with foreign substances such as poison by using a syringe needle. The hole produced by the needle can be located to escape notice so that the tampering of the product remains undetected.

Although such malicious tampering could be overcome by enclosing the product in a hard casing, it has until now been uneconomical to do so as it would add significantly to the overall selling cost of the product. Also, such a hard casing could well be difficult to open by the final end user of the product.

Another issue with such packaging is that a child can gain ready access to the contents of the carton when opened. There is no way to child proof such a carton after it has been opened. Although containers having child proof lids can be used, such containers do not provide an air tight seal for the product contained therein once the container is opened. This can result in the subsequence contamination of the product by bacteria or other substances. It is therefore advantageous to be able to maintain the product in an air tight seal until immediately prior to use. It would also be advantageous to be able to dispense the product without having to physically touch the product to further minimise any contamination of that product.

It is therefore an object of the present invention to provide a dispenser for products such as tablets or drugs that overcomes one or more of the abovenoted disadvantages associated with known containers.

With this in mind, there is provided a tamper proof dispenser for a solid dosage product including:

dispensing assembly for holding and dispensing the product;

an outer cover for covering at least a portion of the dispensing assembly to thereby prevent access to the product stored therein; and tamper indication means for indicating a prior displacement of the outer cover.

The dispenser may further include child proofing means for preventing a child from readily moving the cover thereby preventing access to the product contained therein.

The term "solid dosage product" is used to describe products in tablet, capsule or other compact forms.

The dispenser according to the present invention may accommodate at least one conventional twenty or twenty four solid dosage product bubble wrapped sheet. These types of sheets are commonly used to package medicinal tablets or capsules in a sealed state within a cardboard container. To this end, the dispenser may have a generally rectangular shape when seen in plan view. The dispenser may contain at least one said bubble wrapped sheet therein. It is however also envisaged that the dispenser may accommodate naked solid dosage products without any bubble wrapping. The dispenser may also be of an alternative shape as it is not restricted to the conventional rectangular shape of the bubble wrapped sheet. The dispenser may for example be cylindrical in shape, with the outer cover being cylindrical in shape and located over a central dispensing means for the product.

According to one preferred embodiment of the present invention, the outer cover may substantially enclose the dispensing assembly and may be slidably supported over the dispensing assembly. The tamper indication means may prevent sliding motion of the cover over the dispensing assembly which will allow access to the product located therein. According to this preferred embodiment, the tamper indication means may be in the form of a removable part of the outer cover, the removable part being coupled to or partially secured to the dispensing assembly. The separation of the removable part releases the outer cover from the dispensing assembly allowing relative movement therebetween as well as providing a visual indication that the dispenser has been opened. The removable part may be in the form of an elongate tag, at least a portion of the opposing sides of the tag being secured to the outer cover. The tag may be secured to the outer cover by a frangible membrane. The tag may be formed integrally with the outer cover or may be subsequently secured to the outer cover. One end of the elongate tag is provided with a raised ledge that is positioned away from an outer surface of the outer cover. This ledge provides a means whereby a person can lift the end of the tag away from the rest of the dispenser to thereby separate the rest of the tag therefrom. The opposing end of the elongate tag is coupled to the dispensing assembly and is uncoupled therefrom when the elongate tag is removed from the dispenser. The opposing end of the elongate tag may for example be located under an undercut provided on the dispensing assembly. The relative movement of the outer cover and dispensing assembly is therefore prevented until such times as the elongate tag is uncoupled from the dispensing assembly.

Child proofing means may be provided to prevent the dispenser being readily opened by a child after the tamper indication means has been removed. To this end, the child proofing means may include a button mounted on the end of a tongue. The other end of the tongue may be hingedly connected to the rest of the dispensing assembly. The child proofing means may further include means for engaging the outer cover. The engagement means could for example be in the form of a male lug provided on an inner surface of the outer cover, with a cooperating aperture or cavity being provided in the tongue. The lug is captured within the aperture or cavity in the tongue when the cover is closed over the dispensing assembly. Pivotal displacement of the tongue away from the lug by applying a lateral force on the button releases the aperture or cavity of the tongue from the lug thereby allowing movement of the cover over the dispensing assembly. The lateral motion of the button required to release the child proofing means would typically not be comprehended by a young child who would more likely simply try to pull the cover off the dispensing assembly.

The opposing end of the elongate tag of the tamper indication means may be located under an edge of the button to prevent movement thereof until such times as the elongate band is separated from the outer cover.

As hereinbefore noted, the dispensing assembly may be adapted to accommodate at least one said bubble wrap sheet containing the solid dosage product. To this end, the dispensing assembly may include an outer shell for accommodating one or more of these sheets. Each sheet typically includes a plastic membrane having a plurality of depressions to provide a cavity within which each solid dosage product is respectively located. An aluminum foil covers the plastic membrane to thereby seal the product therein.

A plurality of openings may be provided through the outer shell through which the product may exit the dispensing means. The or each bubble wrapped sheet may be located within the shell, with the foil side of the sheet facing the openings, these openings being aligned with a respective cavity of the sheet. Preferably two said sheets may be accommodated within the shell, with the said openings being on opposing sides of the shell. the plastic membrane side of each sheet facing inwardly towards each other, the foil side of each sheet facing the openings in the outer shell. When the outer cover is located in a "closed" position over the dispensing assembly, all of the openings may be covered by the outer cover.

It is however also envisaged that "naked" or unpackaged product may be accommodated within the dispensing assembly. To this end, a membrane may be located over each opening to prevent the product dropping out prematurely from the dispensing assembly. The product can also be loaded into the dispenser in a vacuum which helps to prevent bacteria contamination of the product.

The dispensing assembly may further include an ejection means for ejecting the solid dosage product therefrom. The ejection means may include at least one slide mechanism including an actuation arm upon which is slidably mounted a rider member. Two said actuation arms may preferably be located side by side adjacent a said bubble wrapped sheet where that sheet accommodates two rows of product. Therefore, a total of four said slide mechanisms may be located within the outer shell of the dispensing assembly, two at each side of the dispensing assembly when there are two bubble wrapped sheets accommodated therein. These actuation arms may be slidably supported by an inner support frame located within the outer shell.

An abutment may extend from the rider member, this abutment being for example in the form of a wedge or ramp. The actuation arm may move both forward and backwards in a direction parallel to the elongate axis thereof. The motion of the actuation arm may move the rider member and urge the abutment of the rider member against a product located within a bubble wrap sheet to thereby eject that product out from the bubble, through the foil and out of the shell opening located adjacent the bubble to thereby dispense that product therefrom. Alternatively, the rider member may urge an intermediate abutment arrangement that then engages the product located within the bubble wrap sheet.

The bubble wrap sheet may be located on a support plate having a plurality of apertures allowing the bubble of the sheet to extend therethrough. The intermediate abutment may include a wedge shaped member located over each aperture. This wedge shaped member may be resiliently supported on the support plate and therefore movable relative thereto. The abutment of the rider member can be urged against the wedge shaped member thereby pressing the member against the bubble and the product located therein. This arrangement can provide a greater mechanical advantage reducing the force required to eject the product from the bubble sheet.

The ejection means may further include a ratchet mechanism for preventing any motion of the rider member except in the forward direction. Therefore, any actuation motion of the actuation arm in an initial forward and subsequent rearward motion would result in only a forward movement of the rider member, with the rider member moving under the next bubble in the bubble wrapped sheet to thereby eject the product contained therein. This can continue until such times that the rider member reaches the end of its travel along the actuation arm.

The ratchet mechanism may include a plurality of flexible fingers extending from the actuation arm. Each flexible finger may extend at an acute angle from the plane of the actuation arm and may all point towards the forward direction of the actuation arm. The rider member can move in the forward direction over the top of each finger because of the flexibility of each finger. Each finger may act to push the rider member along the actuation arm, the fingers being spaced therealong to ensure that the rider member can sequentially move under each respective product in the bubble wrapped sheet. The fingers however prevent any rearward motion of the rider member back along the actuation arm. Flexible ratchet fingers may also be provided on a side guide wall of the support frame adjacent each actuation arm. These ratchet fingers may also extend at an acute angle from the plane of the side guide wall and may point in the forward direction of the actuation arm. These ratchet fingers also help to prevent the rider member from moving back along the actuation arm when it moves back in the rearward direction back to its initial position.

Each actuation arm may include a finger rest on one end thereof. This finger rest may be located in an exposed position on the outside of the dispensing means. A person using the dispenser can then displace the actuation arm by applying a force on the finger rest to thereby move the actuation arm. A removable spacer may be provided between the finger rest and an opposing shoulder on the dispensing assembly. This spacer prevents motion of the actuation arm until the spacer is removed from between the finger rest and the shoulder. The removal of the spacer also provides a further indication of any tampering of the dispenser.

It is to be appreciated that the ejection means can also eject more than one product at any one time. For example, a single actuation arm may support a rider member having two abutments located side by side. The movement of the rider member results in the ejection of two products located side by side in the bubble wrapped sheet.

According to a second preferred embodiment of the present invention, the outer cover may be pivotally supported on the dispensing assembly, the outer cover being located over the portion of the dispensing assembly from which the product is dispensed. The tamper indication means may prevent pivotal motion of the outer cover away from the dispensing assembly which could allow access to the product located therein. This embodiment may utilise a dispensing assembly including an ejection means similar to the earlier described embodiment. The ejection means may include at least one slide mechanism including an actuation arm upon which is slidably mounted a rider member adapted to eject the product. Furthermore, the ejection means may similarly include a ratchet mechanism for limiting the motion of the rider member towards the said forward direction.

According to the second preferred embodiment, the outer cover may be operably interconnected with the ejection means such that pivotal movement of the outer cover away from the dispensing assembly may result in at least substantially simultaneous actuation of the ejection means. The pivotal motion of the outer cover may displace the or at least one of the actuation arms thereby displacing the rider member supported thereon, The ratchet mechanism may limit the motion of the rider member towards the forward direction. The outer cover may be pivotally connected adjacent one end thereof using, for example, stub axles extending laterally from opposing sides of the outer cover. That end of the outer cover may be further interconnected by a coupling arrangement to the or each actuation arm. The coupling arrangement may include at least one pivot pin engaged to a cooperating slot arrangement. The or each pivot pin may have a pivot axis extending at least substantially parallel to the pivot axis of the outer cover, and may be supported on an adjacent the said one end of the outer cover. The cooperating slot arrangement may be provided on a rear end of the actuation arm. As the pivot pin may be engaged to the slot arrangement pivotal movement of the outer cover away from the dispensing assembly will result in displacement of the pivot pin within the slot arrangement thereby urging the actuation arm in the forward direction, with the outer cover acting as a lever, the fulcrum being the pivot connection of the outer cover to the dispenser assembly. Pivotal displacement of the outer cover back to its initial position against the dispensing assembly results in the actuation arm being retracted back to its initial position prior to actuation thereof.

The tamper indication means may be provided on the opposing end of the outer cover to the coupling arrangement. The tamper indication means may be similar in construction to that described in the Applicant's co-pending International patent application No. PCT/AU01/00844 filed on Jul. 13, 2001. Details of this application are incorporated therein by reference. In particular, the tamper indication means may include a locking element(s) separable from the product dispenser to thereby allow displacement of the outer cover from the dispensing assembly, the removal of the locking element(s) further providing a visual indication that the product dispenser has been opened.

The locking element(s) may be adapted to allow an initial engagement of the outer cover when located over the dispensing assembly while preventing subsequent removal therefrom.

The locking element(s) may include a locking tab which may be integrally formed with the outer cover by a frangible connection. The locking tab may cooperate with a child proofing means for preventing a child from readily moving the outer cover thereby preventing access to the product contained therein.

The child proofing means may include an engagement means for engaging the outer cover to the dispensing assembly. The engagement means may include a manual actuator mechanism having a biased latch. A coupling arrangement may be provided between the outer cover and the dispensing assembly which may be released by movement of the biased latch. The coupling arrangement may include one or more lugs supported on the manual actuator mechanism for engaging one or more apertures provided in the outer cover. The apertures may be provided in tags extending from an inner face of the outer cover. With the outer cover located over the dispensing assembly, the locking tab may prevent movement of the latch thereby preventing the release of the outer cover from the dispensing assembly.

The latch may extend through an aperture provided in the outer cover, with the locking tab forming one side of the aperture. Removal of the locking tab provides clearance to allow the latch to be moved thereby enabling the outer cover to be opened.

It will be convenient to further describe the invention with respect to the accompanying drawings which illustrate preferred embodiment's of the tamper proof dispenser according to the present invention. Other embodiments of the dispenser are also possible, and consequently, the particularity of the accompanying drawings is not to be understood as superceding the generality of the preceding description of the invention.

in the drawings:

FIGS. 1*a* and *b* are respective isometric views of a first preferred embodiment of a dispenser according to the present invention in a closed state;

FIGS. 2*a* to *c* are respectively isometric and a detailed view of an outer cover of the dispenser of FIGS. 1*a* and *b;*

FIGS. 3*a* to *c* are respective detailed views of the dispensing means of the dispenser of FIGS. 1*a* and *b;*

FIGS. 4*a* to *c* are respectively an isometric, side and detailed view of the outer shell of the dispensing assembly of FIGS. 3*a* to *c;*

FIGS. 5*a* to *d* are respectively isometric, side, end and a detailed view of the support frame located within the outer shell of FIGS. 5*a* to *c;*

FIGS. 6*a* to *c* are respectively isometric and a side view of a slide mechanism located on the support frame of FIGS. 5*a* to *d*; and FIG. 7 is an isometric partially cross-sectional view of a dispensing assembly of the dispenser of FIGS. 1*a* and *b;*

Figure 15:
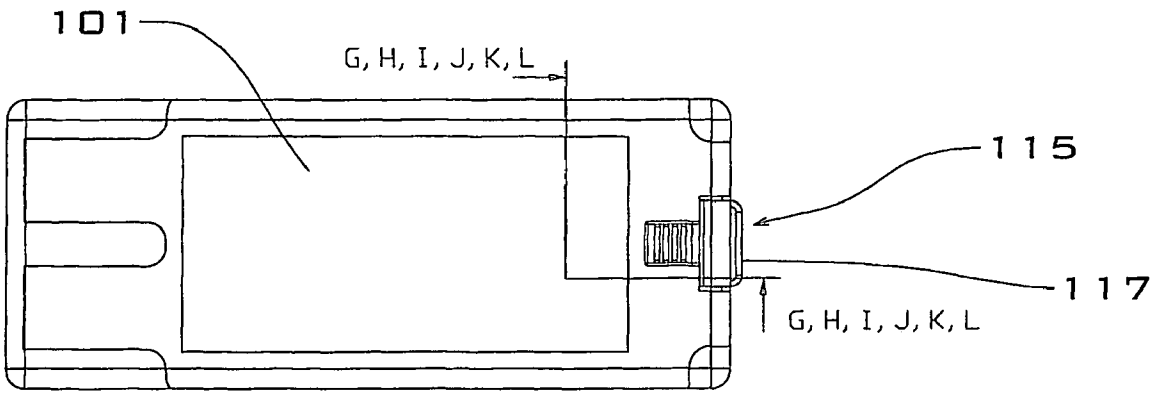
FIG. 15 is a plan view of the dispenser of FIG. 8.

FIGS. 16*a* to 16*f* are a detailed cross-sectional view taken along the section lines shown in FIG. 15

Figures 1A, 1B:
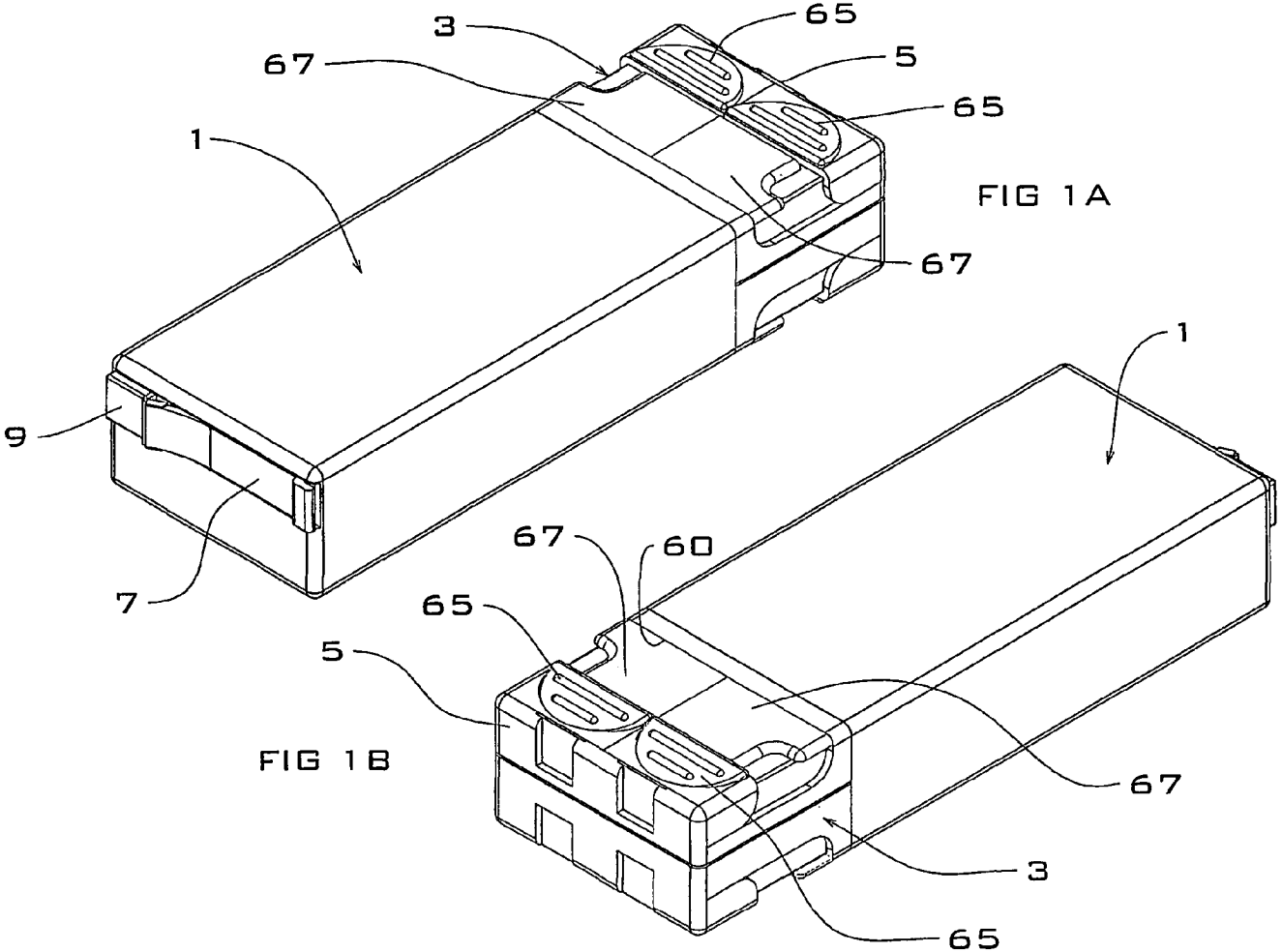

Referring initially to FIGS. 1*a* and *b*, the first preferred embodiment of the dispenser according to the present invention includes an outer cover 1 covering a dispensing portion of a dispensing assembly 3. FIGS. 1*a* and *b* shows the dispenser in a closed position with only an outer end 5 of the dispensing assembly 3 being visible when the cover 1 is located thereon.

The dispenser includes a tamper indication means in the form of a removable elongate tag 7, the operation of which will be subsequently described. Furthermore, the dispenser includes a child proofing means which includes an external button 9 located at one end of the dispenser. The operation of the child proofing means will also be subsequently described.

The outer end 5 supports four separate finger rests 65, two on each side of the dispenser. These finger rests 65 allow the dispensing assembly 3 to be actuated. A respective spacer member 67 is provided between each finger rest 65 and a shoulder 60 provided on the dispensing assembly 3. Each spacer member 67 including a lateral tab 68 to allow that spacer member 67 to be lifted and separated from the dispensing assembly. The operation of the finger rests 65 and spacer members 67 will be subsequently described.

Figures 2A, 2B, 2C:
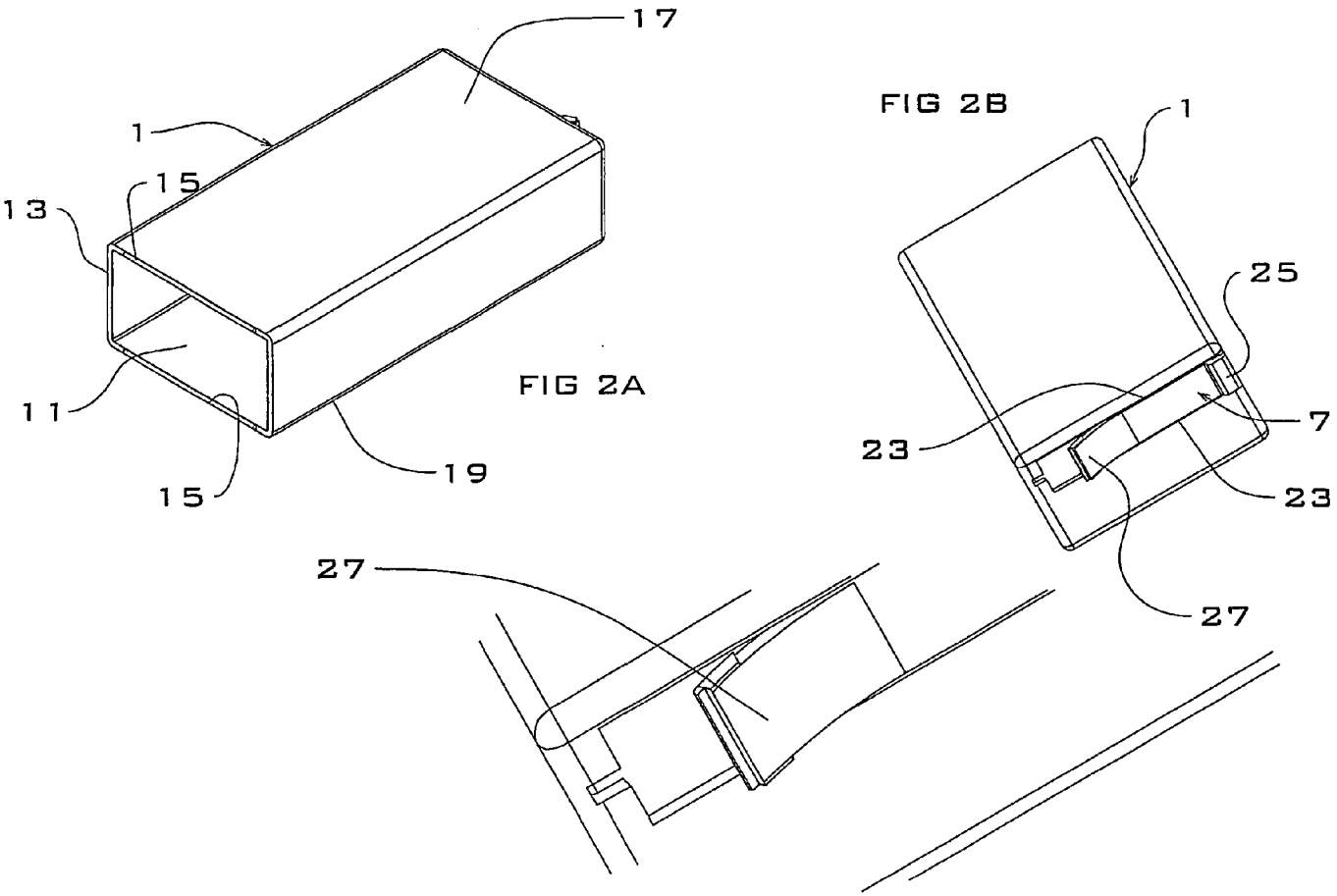

FIGS. 2*a* to *c* provide further details of the outer cover 1 which is slideably supported over the dispensing portion of the dispensing assembly 3. To this end, the outer cover 1 includes an entrance opening 11 through which the dispensing portion of the dispensing assembly 3 can enter the cover 1. The peripheral edge 13 of the entrance opening 11 is also provided with a seal rib 15 located adjacent a top face 17 and bottom face 19 of the cover 1. These seal ribs 15 are accommodated within a cooperating groove 20 (shown in FIG. 4*a*) provided on a shoulder 39 of the dispensing assembly 3. This sealing arrangement prevents the ready access of a hypodermic needle between the junction of the outer cover 1 and the dispensing assembly 3 when the dispenser is closed.

FIGS. 2*b* and *c* show in more detail the tamper indication tag 7. This tag 7 can be integrally formed with the rest of the outer cover 1 and may be secured thereto by a frangible tear zone 23 along opposing elongate edges of the tag 7. One end of the tag is provided with a tab 25 which is raised above the surface of the outer cover 1 and allows a user of the dispenser a means to lift the tag 7 away from and thereby separate the tag 7 from the rest of the outer cover 1.

At the opposing end of the tag 7 from the tab 25 is provided a raised abutment finger 27 which is located under the button 9 of the child proofing means when the dispenser is initially assembled. This abutment finger 27 prevents any substantial movement of the button 9 until the elongate tag 7 is removed from the outer cover 1.

Figure 3A:
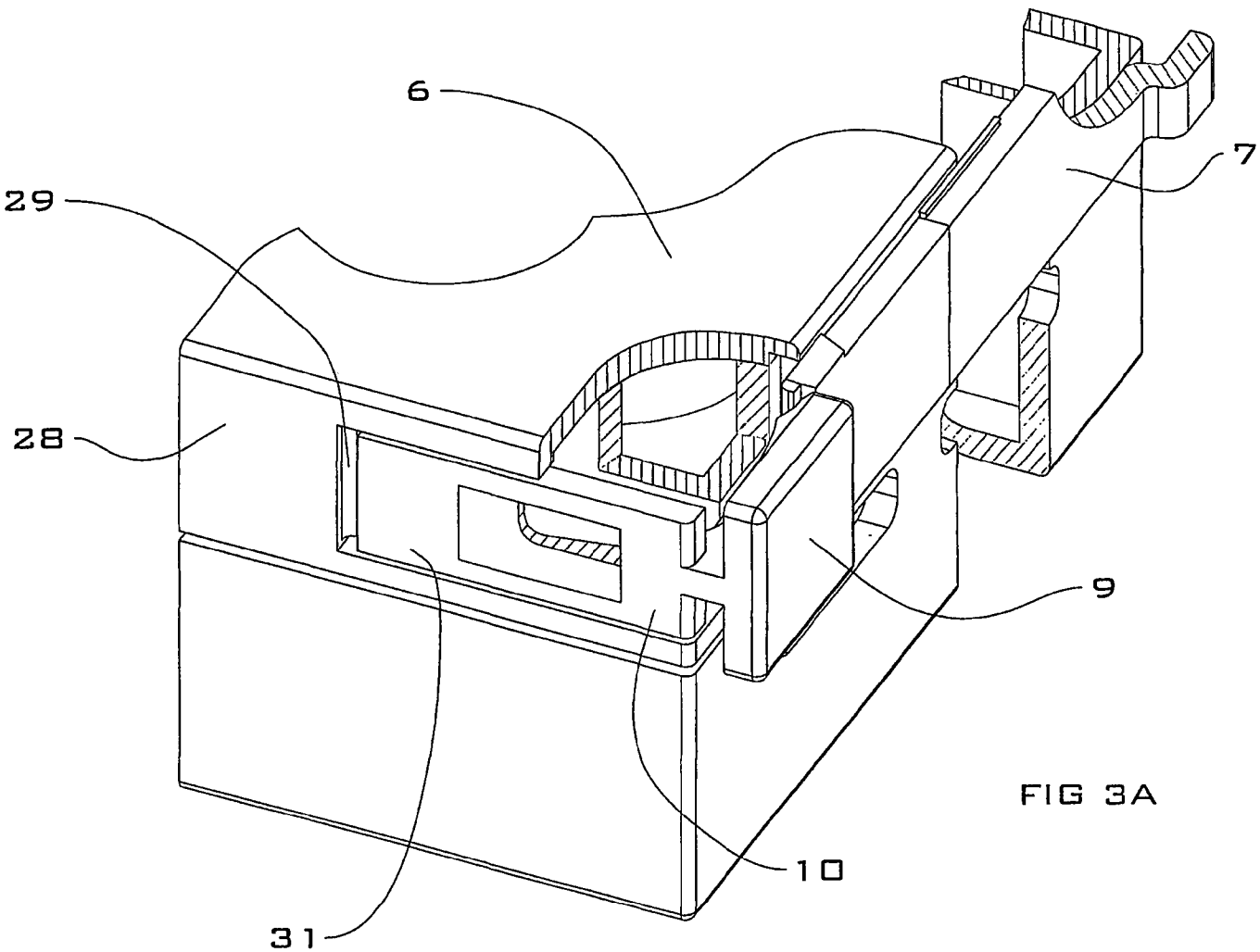
Figure 3B:
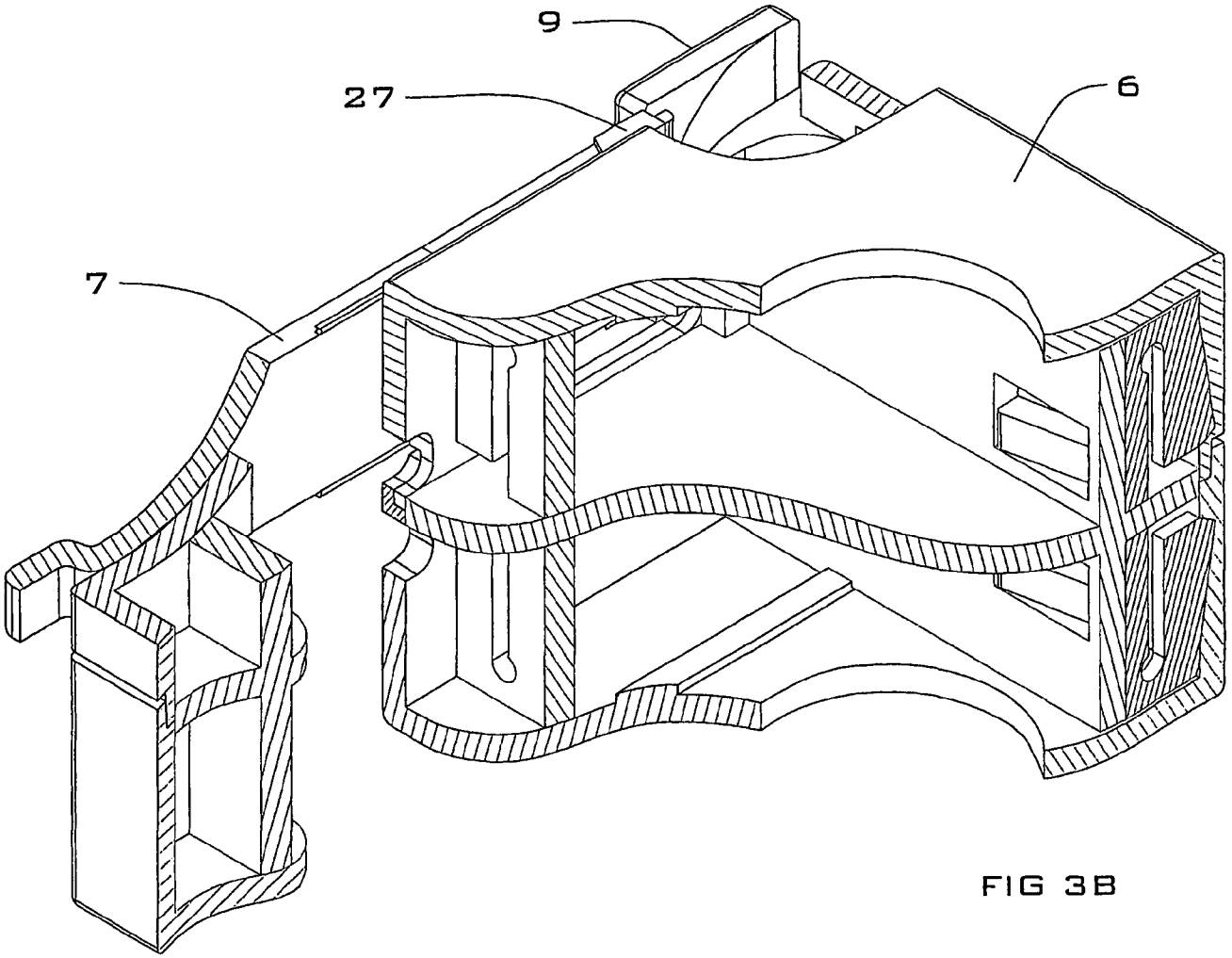

FIGS. 3*a* and *b* show in more detail the interaction between the elongate tag 7 and the button 9. FIGS. 3*a* and *b* show the arrangement at the end of the dispensing portion 6 of the dispensing assembly 3 with the outer cover otherwise not shown except for the tag 7. The button 9 is supported on a tongue 10 which is hingedly supported by a flexible hinge 29 to a side wall 28 of the dispensing portion 6. The tongue 10 is provided with an aperture 31. When the elongate tag 7 is in position as shown in FIG. 3*a*, the button 9 is prevented from any significant pivotal movement about the flexible hinge 29 because of the abutment finger 27 resting against the underside of the button 9. This is more clearly shown in FIG. 3*b* which provides a view of the tag 7, button 9 and abutment finger 27 when viewed from the interior of the dispenser.

Figure 3C:
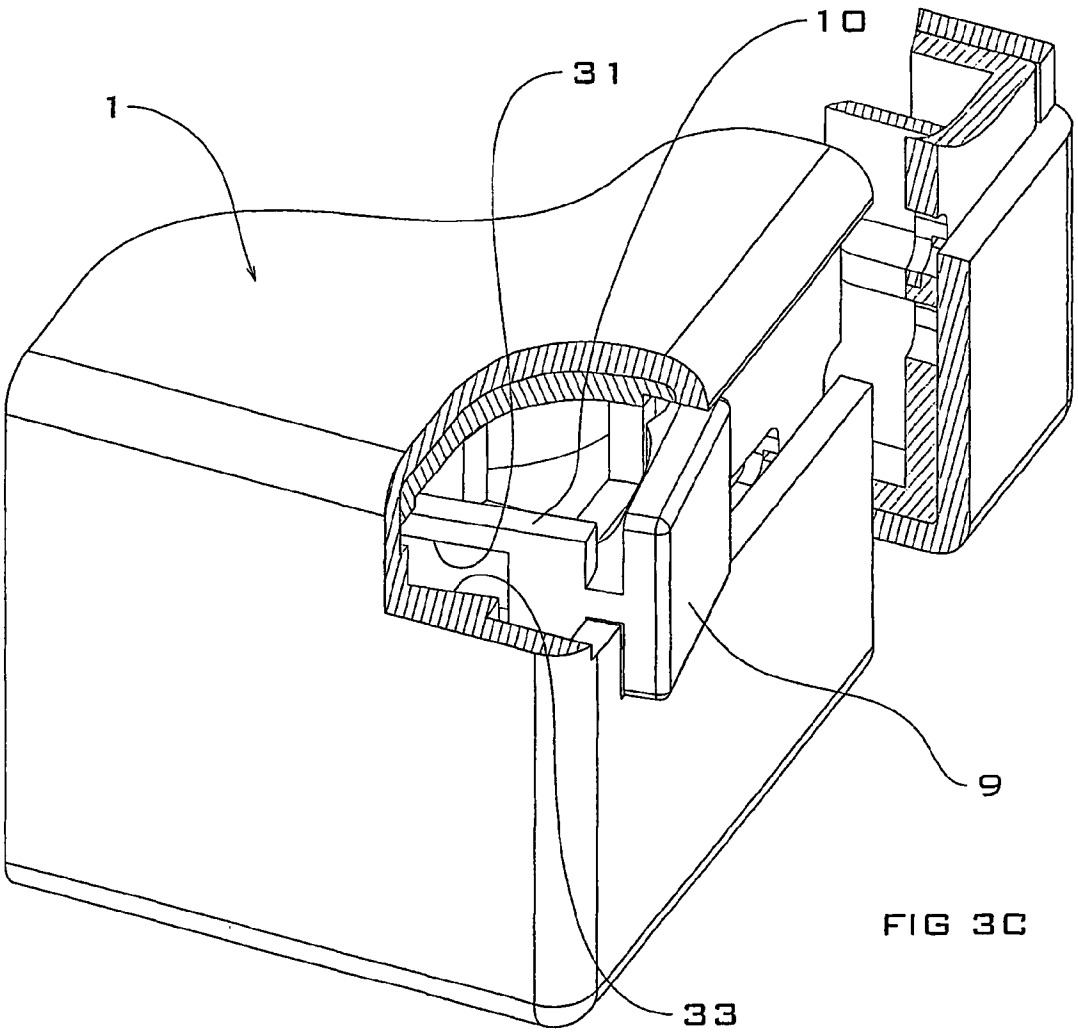

When the tag 7 is removed, then the button 9 is able to move inwards as shown in FIG. 3*c*. Also shown in FIG. 3*c* is the outer cover 1, which is provided with an internal lug 33. This lug 33 is aligned with the aperture 31 of the tongue 10 when the cover 1 is in a closed position over the dispensing assembly 3. When the button 9 is in the position shown in FIGS. 3*a* and *b*, the aperture 31 accommodates the lug 33 to thereby prevent the cover 1 sliding off the dispensing portion 6. However, following the removal of the tag 7, the button 9 can be moved inwards thereby releasing the tongue aperture 31 from the lug 33 of the outer cover 1. This then allows the cover 1 to be removed from the dispensing portion 6.

The elongate tag 7 therefore provides a tamper indication means for the dispenser according to the present invention. The removal of this tag 7 provides a visual indication of the opening of the dispenser. Furthermore, the arrangement of the button 9 and the cooperation of the tongue aperture 31 with the lug 33 of the outer cover 1 provides a child proofing means for the dispenser according to the present invention. A young child would not readily appreciate that it is necessary to deflect the button 9 inwards while at the same time sliding open the cover 1.

Figure 4C:
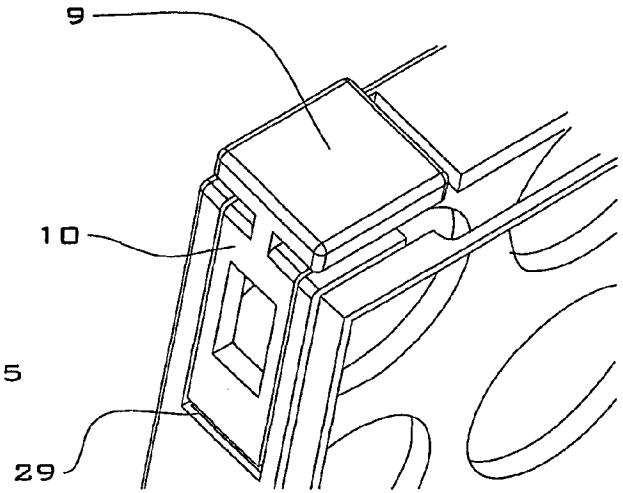
Figure 4B:
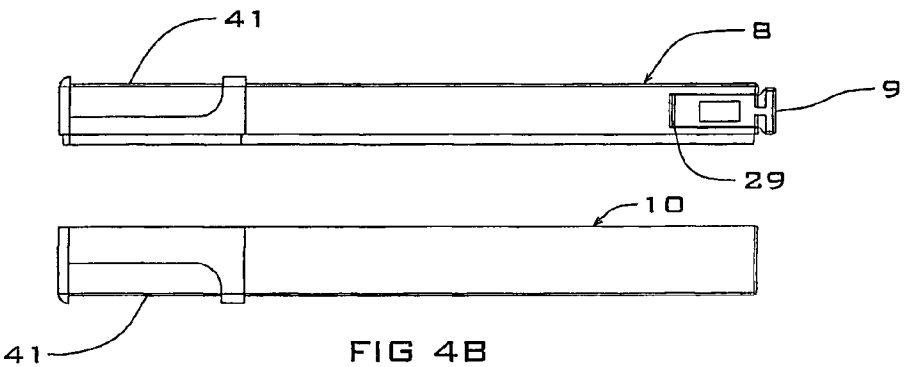
Figure 4A:
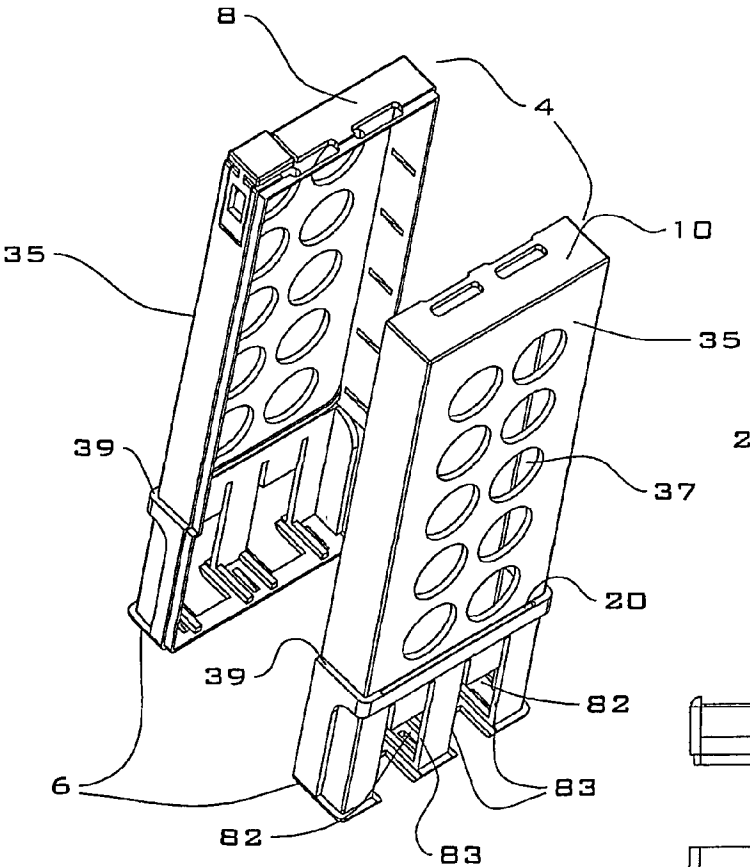
Figure 5A:
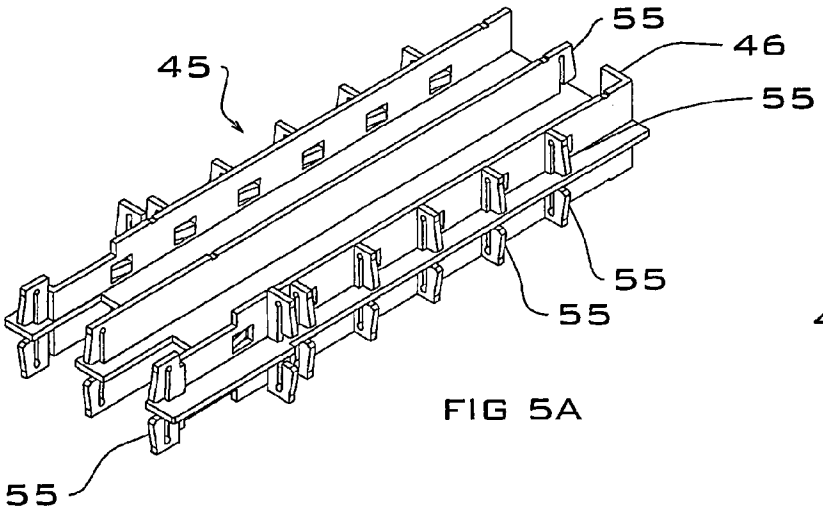
Figure 5B:
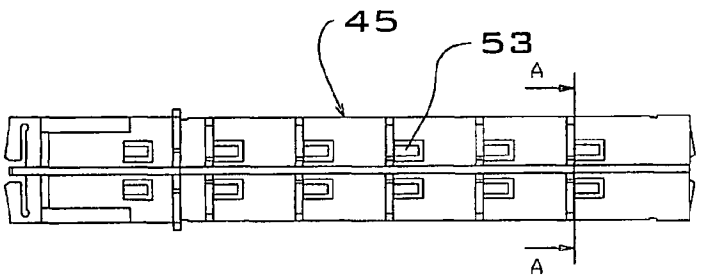
Figure 5C:
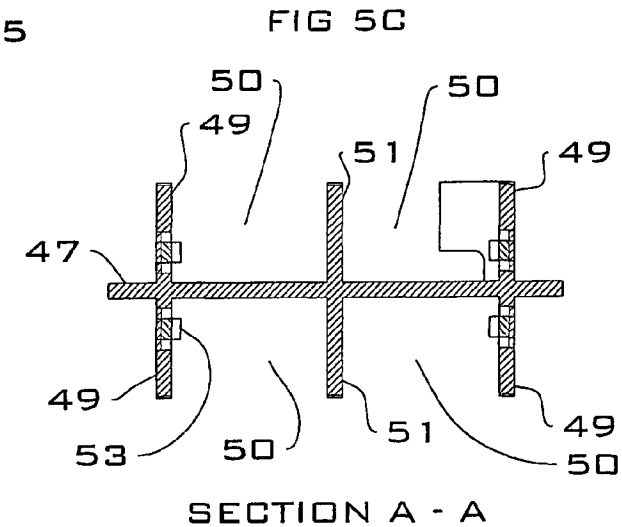
Figure 5D:
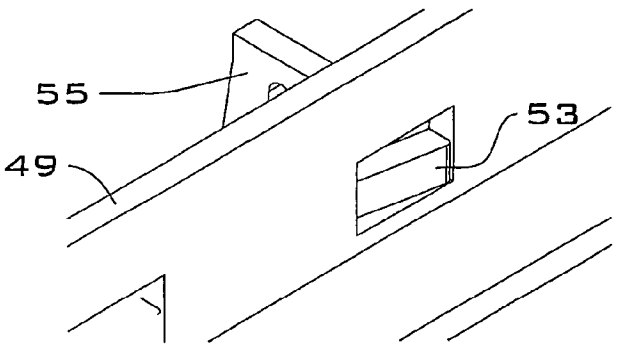

FIGS. 4*a* to 4*c* provide further details of the construction of the dispensing assembly 3. This assembly includes an outer shell 4 formed of two half shells 8, 10. Each half shell includes a dispensing face 35 through which is provided a plurality of openings 37. These openings are sized and spaced to correspond with the location of a single dosage product in a conventional bubble wrapped sheet. When the two half shells 8, 10 are assembled, the dispensing face 35 is provided on the dispensing portion 6 of the dispensing assembly 3. Each half shell 8, 10 further includes an abutment shoulder 39 upon which the outer cover 1 can abut when closed. To this end, the groove 20 shown in FIG. 4*a* engages the seal rib 15 shown in FIG. 2*a*. One half shell 8 is provided with the button 9, tongue 10 and flexible hinge 29 of the child proofing means. The half shells 8, 10 also provide the outer end 6 of the dispensing assembly 3 which is not covered by the outer cover 1.

The section of each half shell 8, 10 which form the outer end 6 of the dispensing assembly 3 are provided with two parallel slots 82, each slidably accommodating the finger rests 65 shown in FIGS. 1*a* and *b* when the dispenser is assembled. The finger rests 65 are adapted to engaging the opposing peripheral edge of each slot 82.

FIGS. 5*a* to 5*d* show a support frame 45 which is accommodate within the assembled half shells 8, 10. This support frame 45 includes a central plate 47. From each side of the central plate 47 extends two parallel side guide walls 49 and a central guide wall 51. These guide walls 49, 51 together with the central plate 47 together define slide passages 50, two on each side of the central plate 47. The side guide walls 49 further include a plurality of flexible fingers 53 extending along the length of the guide wall 49. Each finger extends at an acute angle from the plane of the side guide wall 49 and point in the same direction. These flexible fingers 53 provide part of a ratchet mechanism as will be subsequently described.

Along the peripheral edge of the support frame 45 are provided a plurality of resilient retainers 55. These resilient retainers 55 may be integrally formed as part of the support frame 45 and act to retain and lock the support frame 45 in position within the outer shell 4 of the dispensing assembly 3 when located therein.

The support frame 45 further includes a fire wall 46 which is located behind the button 9 when in the installed position. This fire wall 46 provides a further barrier to any attempted access of a hypodermic needle from behind that button 9.

Figure 6C:
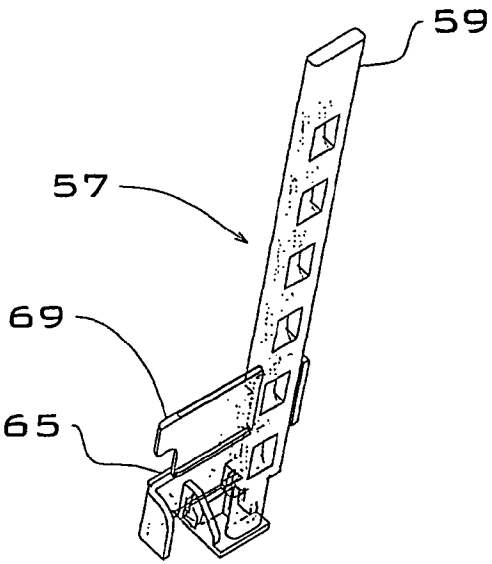
Figure 6A:
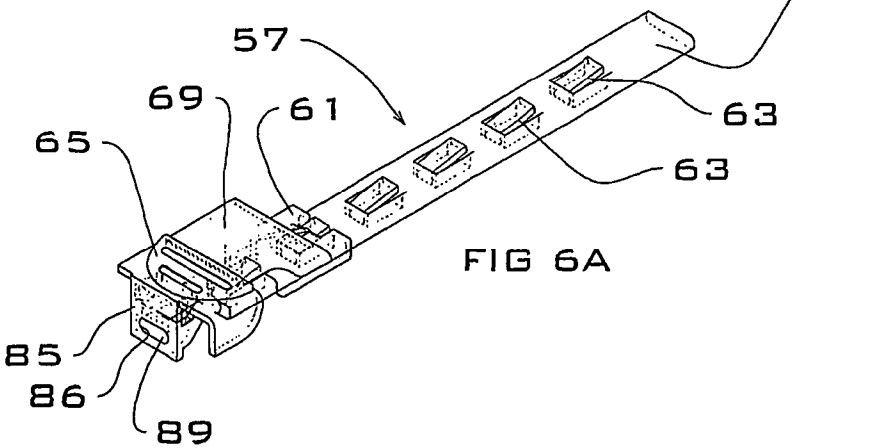
Figure 6B:
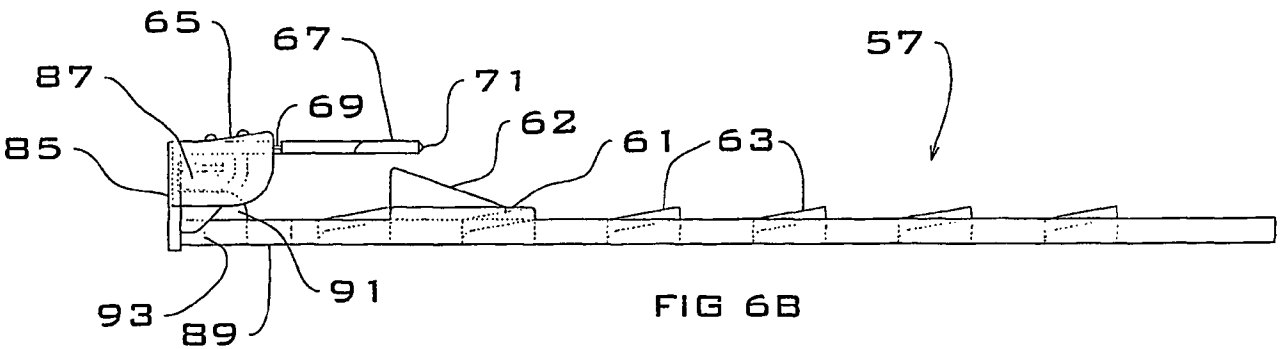

Each slide passage 50 accommodates an actuation mechanism 57 as shown in FIGS. 6*a* to *c*. This actuation mechanism 57 includes an actuation arm 59 upon which is supported a rider member 61. Located on the rider member 61 is an abutment 62 which is shown in the form of a ramp. The actuation arm 59 further includes a plurality of flexible fingers 63 extending along the length of the actuation arm 59. Each flexible finger 63 extends at an acute angle from the plane of the actuation arm 59 and point in a "forward" direction of the actuation mechanism 57, being towards the end of the dispensing portion 6. When the actuation mechanism 57 is located within the slide passage 50, the flexible fingers 53 of the side guide walls 49 point in the same forward direction as the flexible fingers 63 of the actuation arm 59. Both the flexible fingers 63 of the actuation arm 59 and the flexible fingers 53 of the side guide walls 49 together provide a ratchet mechanism for the dispensing assembly 3.

The actuation mechanism 57 further includes the finger rest 65 shown in FIGS. 1*a* and *b* located at a rear end of the actuation arm 59.

The finger rest 65 is located on an exposed surface of a connector member 85 adapted to connect to one end of the actuation arm 59. This connection member 85 includes a slot 86 for accommodating an end portion 89 of the actuation arm 59 which is narrower than the rest of that arm. A hook 91 extends from that connector member 85 for engaging a slot 93 provided in the actuation arm end portion 89. On opposing sides of the connector member 85 are provided flexible lugs 87. These lugs 87 have sufficient flexibility to allow the connector body 85 to be pushed into a respective slot 82 of the dispensing assembly 3, with the flexible lugs 87 deflecting inwardly and being retained under the peripheral edge 83 thereof. At the same time, the connector member 85 connects to the actuator arm end portion 89 by means of the hook 91 and slot 86. The connector member 85 can then move as a unit together with the actuation arm 59.

The spacer member 67 shown in FIGS. 1*a* and *b* is located in a position forward of the finger rest 65. Furthermore, the spacer member 67 is attached by a frangible connection 69 to the finger rest 65. An engagement rib 71 is provided at the opposing end of the spacer member 67. This engagement rib 71 cooperates with an engagement groove 73 (shown in FIG. 7) provided on the shoulder 60 of the dispensing assembly 3 when the actuation mechanism 57 is installed in the dispensing assembly 3. The spacer member 67, when resting flush on the outer end 5 of the dispensing assembly 3 blocks any movement of the finger rest 65, and therefore the rest of the actuation mechanism 57.

Figure 7:
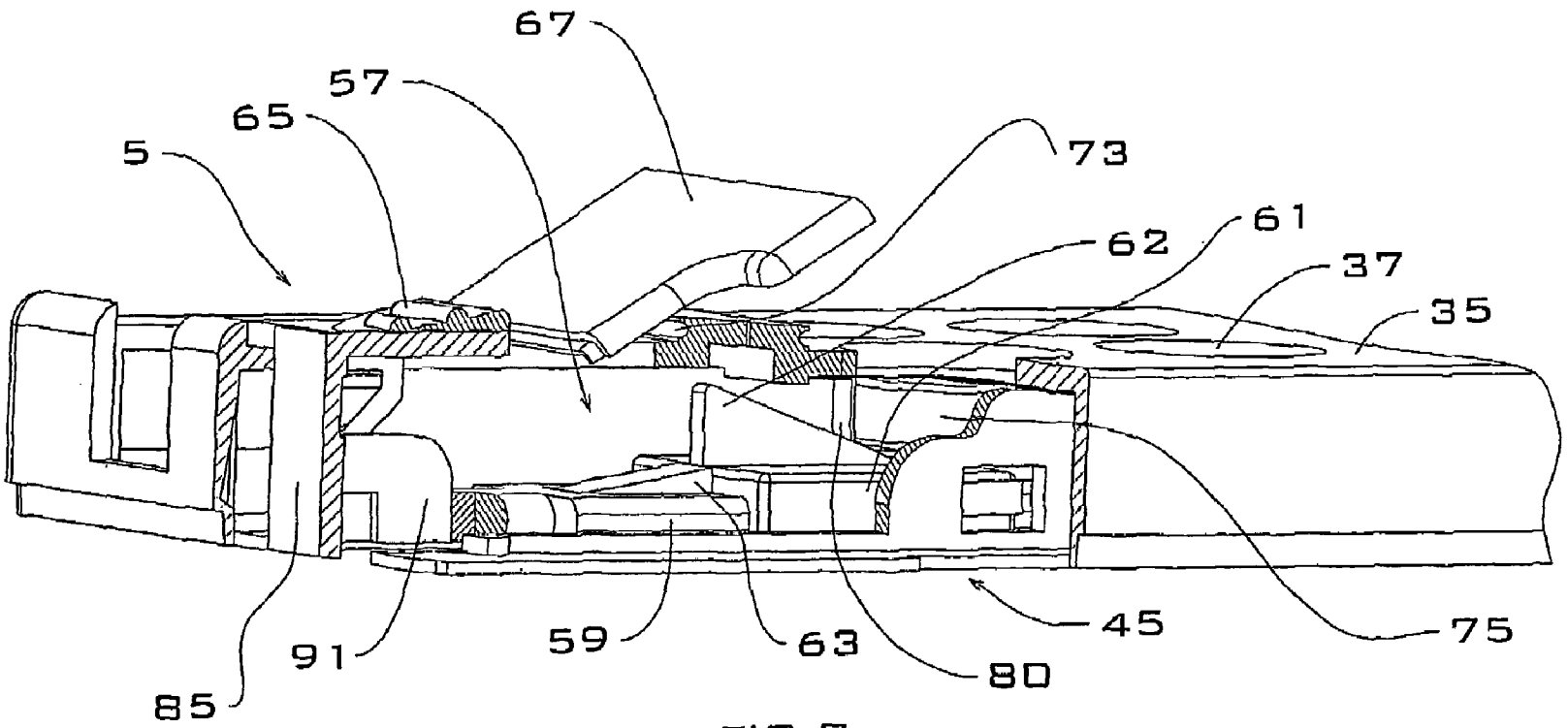
Figure 8:
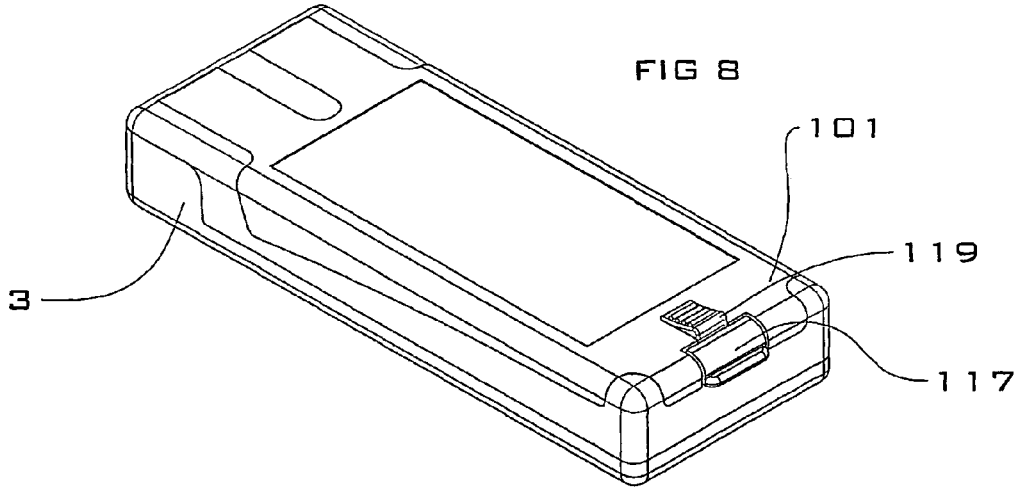
FIGS. 8 to 10 are respectively isometric, side and plan views of a second preferred embodiment of a dispenser according to the present invention in a closed state.
Figure 9:
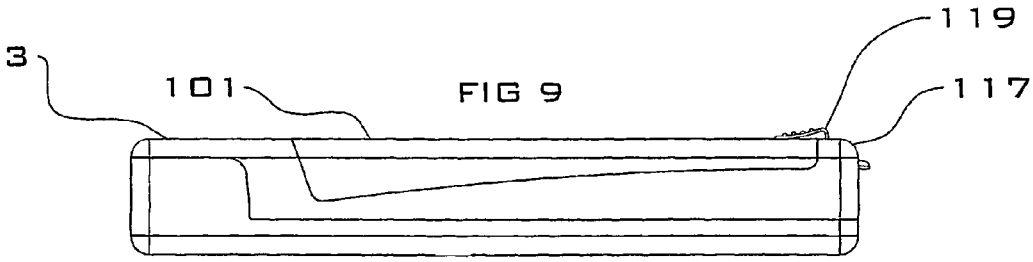
Figure 10:
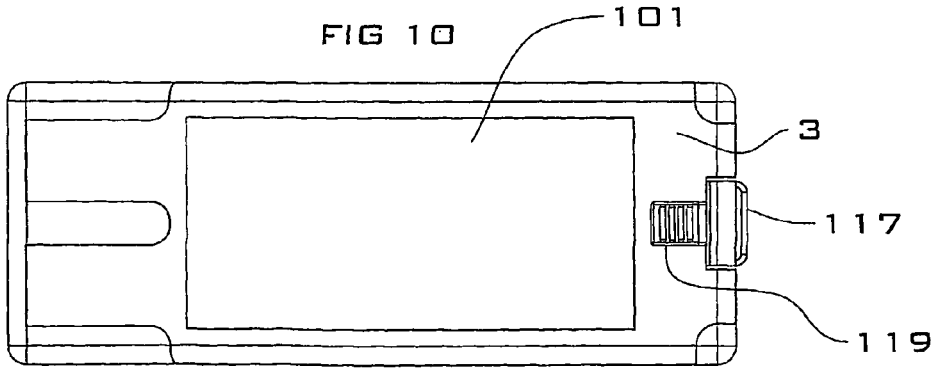
Figure 11:
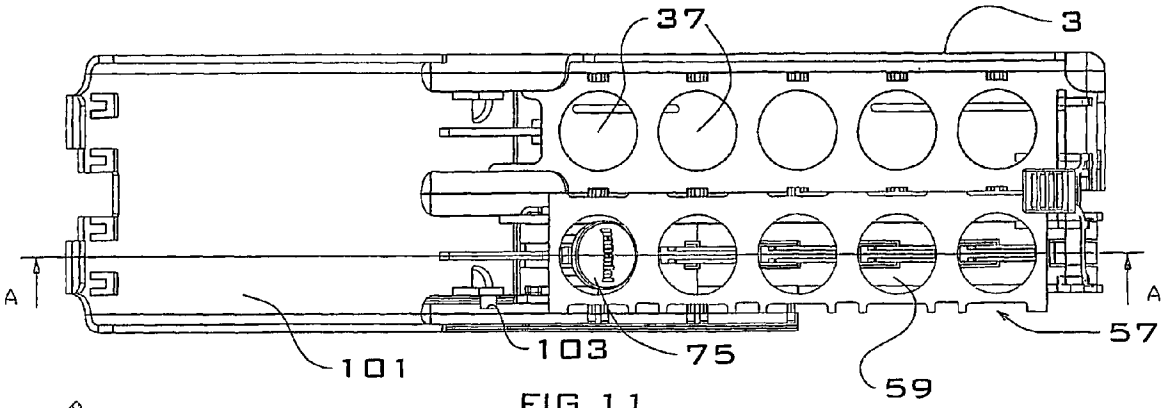
FIG. 11 is a plan and partial cross-sectional view of the dispenser of FIG. 8 with the outer cover open.
Figure 12:
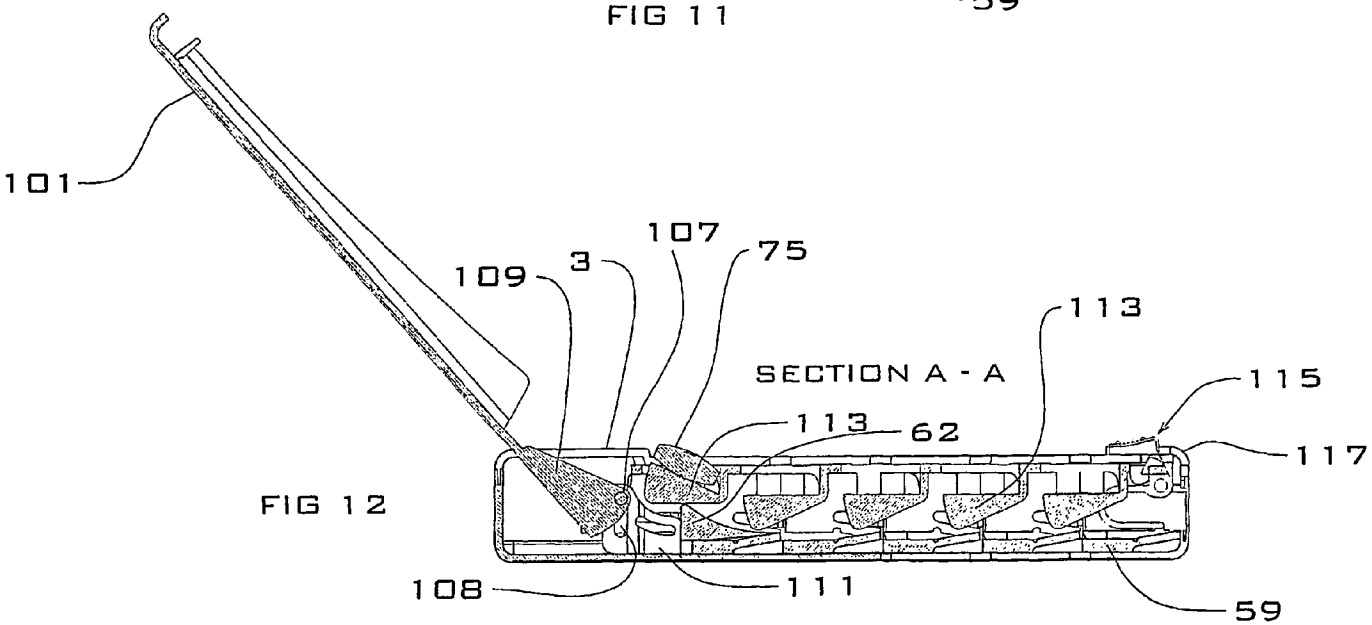
FIG. 12 is a side cross-sectional view through section A-A of FIG. 11.

FIG. 7 shows in more detail the dispensing assembly 3 when assembled. In particular, FIG. 7 shows a partial cross-sectional view of the dispensing assembly 3 showing the actuation mechanism 57 supported within the support frame 45. Also shown is the rider member 61 in its initial position on the actuation arm 59 prior to ejection of the first single dosage product 75. The spacer member 67 must initially be removed and separated from the finger rest 65 to enable the actuation mechanism 57 to be moved. FIG. 7 shows the spacer member 67 in a partially separated position. Following the removal of the spacer member 67, the actuation arm 59 can move forwards by applying finger pressure on the finger rest 65. The actuation arm flexible finger 63 urges the rider member 61 in the forward direction such that the rider member abutment 62 is pushed under the first single dosage product 75, a portion of which is shown in FIG. 7. This product 75 is in the form of a tablet supported within a bubble of a bubble wrapped sheet 80. This sheet 80 is located with the foil face thereof facing the openings 37 of the dispensing face 35. As the rider member 61 is urged forward, the abutment 62 pushes the product 75 from the supporting bubble, through the foil and out the opening 37.

At the end of the ejection process, the guide wall flexible fingers 53 prevent the return of the rider member 61 to its initial position. The guide wall flexible fingers 53 press against the rider member 61 to prevent any rearward movement while the next actuation arm flexible finger 53 is allowed to slide under and behind the rider member 61. That subsequent actuation arm flexible finger 63 can therefore push the rider member 61 forward at the next ejection process. The rider member 61 therefore progresses along the actuation arm 59 until all of the product 75 located adjacent the actuation mechanism 57 has been ejected. The next row of product 75 can then be ejected in the same manner.

FIGS. 8 to 16*f* are directed to a second preferred embodiment of the present invention. Features corresponding to features of the first described embodiment are designated with the same reference numerals for clarity reasons.

The principal difference is that, in place of the slidably mounted outer cover, there is used an outer cover 101 which is pivotally supported on the dispenser assembly 3. The outer cover 101 covers the opening 37 provided in the dispensing assembly 3 from which the product 75 is dispensed.

Figure 13:
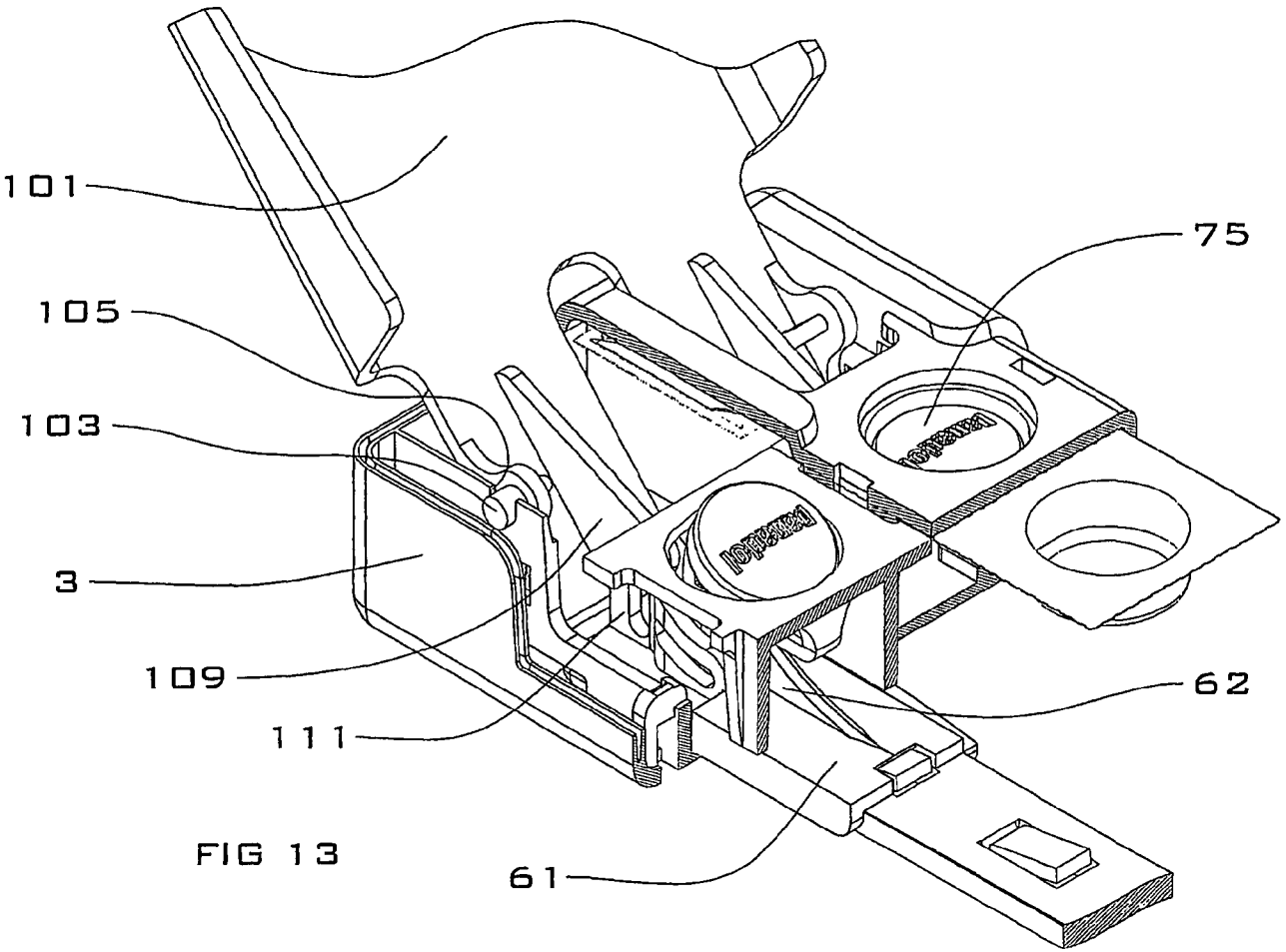
FIGS. 13 and 14 are respectively detailed isometric views of the dispenser of FIG. 8.
Figure 14:
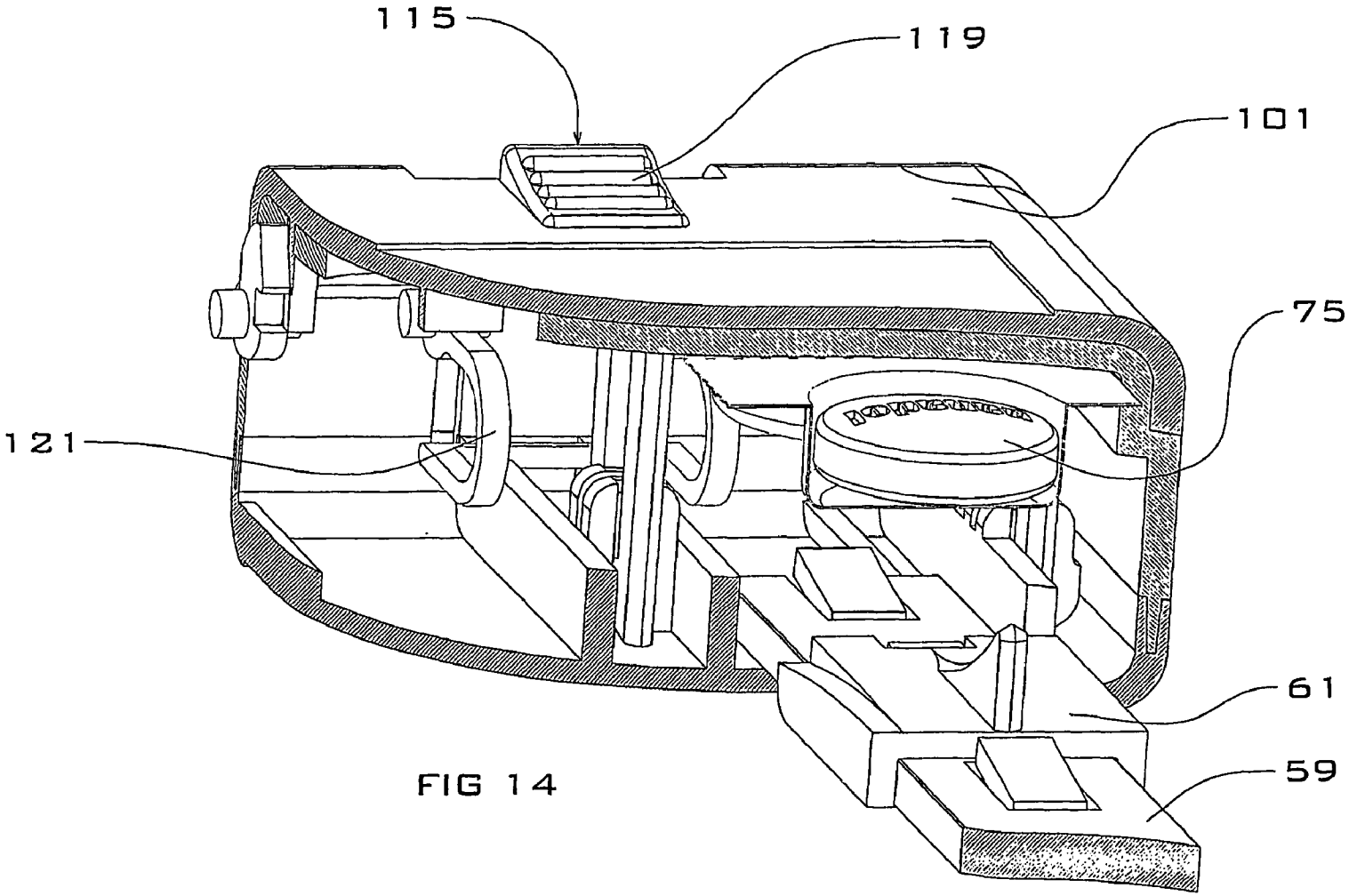

The outer cover 101 is pivotally mounted on the laterally extending stub axles 103 mounted in pivot points 105 provided within the dispensing assembly 3 providing a pivotal connection from the outer cover 101 (best shown in FIG. 13). At that end of the outer cover are also provided pivot pins 107 that are mounted on brackets 109 extend from the inner face of the outer cover 101. The pivot pins 107 are respectively accommodated within a corresponding slot 108 provided in a bracket 111 located at a rear end of the actuation arm 59 of the actuation mechanism 57 (best shown in FIG. 12). A pivotal displacement of the outer cover 101 away from the dispensing assembly 3 about the pivotal connection results in a displacement of the actuation arm 59 in the forward direction. The actuation mechanism 57 works in the same way as the first preferred embodiment, with the forward movement of the actuation arm 59 resulting in the ejection of the product 75 from the dispensing assembly. Supported on 59 each actuation arm is a rider member 61 having an abutment 62. The abutment 62 engages resiliently mounted wedge shaped member 113 which is then urged against the product 75 to displace it from the bubble wrap sheet (best shown in FIGS. 12 and 13). The actuation mechanism 59 uses the same ratchet mechanism as in the earlier embodiment and will not be described again. This arrangement therefore allows for at least substantially simultaneous opening and dispensing of product 75.

The other principal difference of the present embodiment from the earlier described embodiment is the tamper indication means and the child proofing means. FIGS. 14 to 16*f* best show this arrangement which is located at the opposing end of the outer cover 101 to the pivotal end thereof.

The child proofing means includes a manual actuator mechanism 115, and the tamper indication means includes a locking tab 117. The manual actuator mechanism 115 includes a biased latch 119 supported on a resilient mount 121. Supported on the actuator mechanism 115 and lugs 123 which engage cooperating apertures 125 provided on tags 124 extending from an inner face of the outer cover 101.

The child proofing means operates by the movement of the biased latch which releases the lugs 123 from the cooperating apertures 125 thereby releasing the outer cover 101. The movement of the biased latch 119 is however blocked by the locking tab 117. This locking tab is integrally formed with the outer cover 101 with a frangible connection 118 being provided between the locking tab 117 and the rest of the outer cover 101. The outer cover 101 cannot therefore be opened until the locking tab 117 is removed. The removal of this locking tab 117 provides the visual indication of the prior opening of this product dispenser.

Figure 16A:
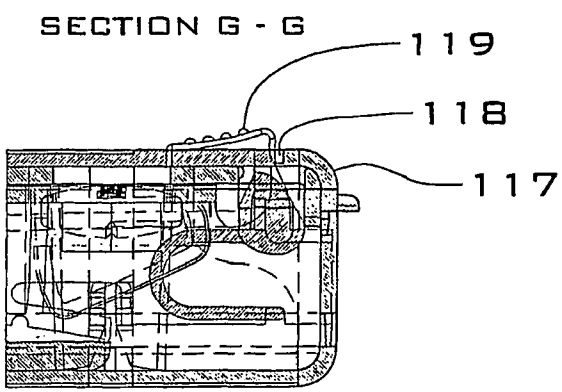
Figure 16B:
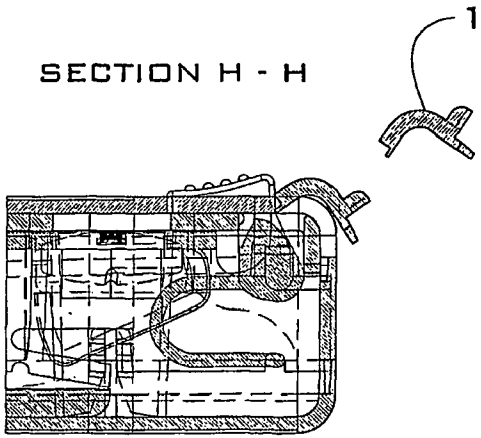
Figure 16C:
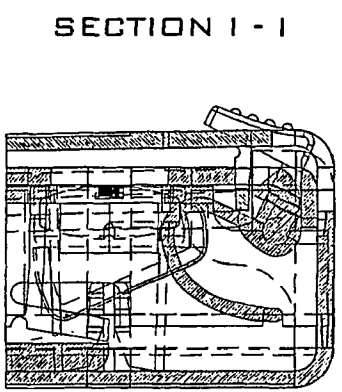
Figure 16F:
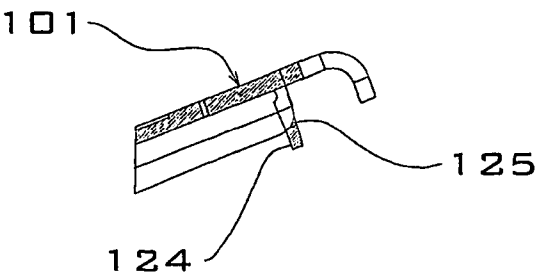
Figure 16F:
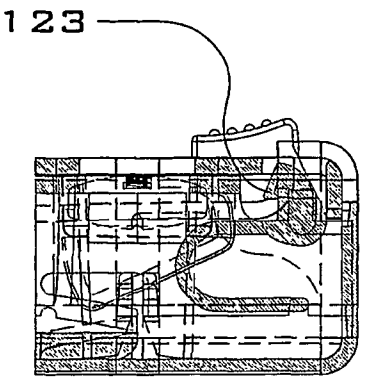
Figure 16E:
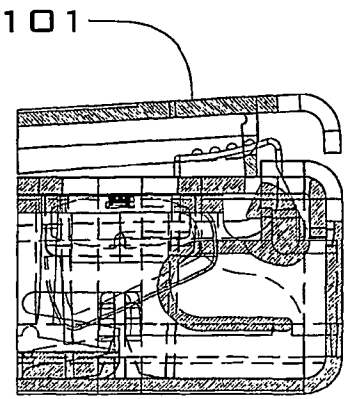
Figure 16D:
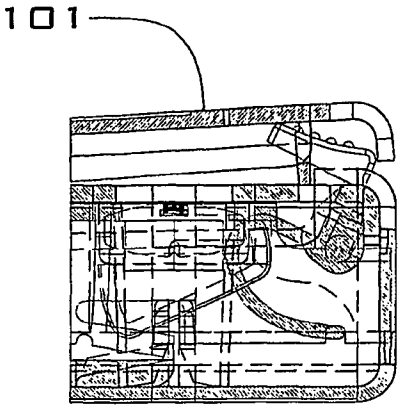

FIGS. 16*a* to 16*f* show the sequence of operation of the tamper indication means and child proofing means. Following removal of the locking tab 117 (FIG. 16*b*), the biased latch 119 can be displaced (FIG. 16*c*) releasing the outer cover (FIGS. 16*d* to 16*f*).

The dispenser according to the present invention provides a tamper indication means which allows a person to be aware that the dispenser has been opened. Furthermore, according to the preferred embodiments described herein, the dispenser can also provide child proofing means to prevent the ready opening of the dispenser by a young child after the tamper indication means has been removed. Furthermore, the solid dosage product stored within the dispenser can be hygienically ejected without any human contact reducing the possibility of bacterial or other contamination of the product.

Modifications and variations as would be deemed obvious to the person skilled in the art are included within the ambit of the present invention as defined in the appended claims.

The invention claimed is:

1. A tamper proof product dispenser for a plurality of product units of a solid dosage product, the dispenser comprising:

a dispensing assembly comprising a housing having an upper and a lower wall for holding and dispensing the product;

the upper wall having an outer face and a plurality of outlets, where each outlet is in its use associated with a product unit which is retained between the upper and lower wall and proximate a respective outlet;

an outer cover for covering at least the outer face to thereby prevent access to the product stored within the dispenser; and tamper indication means for indicating a prior displacement of the outer cover, the dispensing assembly includes ejection means located within the dispensing assembly for ejecting the product units therefrom, the ejection means comprising at least one slide mechanism having an actuation arm received between the upper and lower wall which is slidably retained therebetween and upon which is slidably mounted a rider member adapted to eject the product; and the actuation arm being movable to be reciprocal within the housing, whereby motion of the actuation arm in one direction moves the rider member into an engagement with a product unit such that the solid dosage product is urged out of the dispensing assembly to thereby dispense the product therefrom and on motion of the actuation arm in another direction the rider remains stationary within the housing.

2. A tamper proof product dispenser according to claim 1, the dispenser is adapted to accommodate at least one solid dosage product bubble wrapped sheet, each sheet including a plastic membrane having a plurality of depressions to provide a cavity within which each solid dosage product is respectively located, and an aluminum foil covering the plastic membrane to thereby seal the product therein.

3. A tamper proof product dispenser according to claim 2, the dispensing assembly includes an outer shell for accommodating the at least one bubble wrapped sheet.

4. A tamper proof product dispenser according to claim 3, a plurality of openings are provided through the outer shell through which the product may exit the dispensing assembly, each said bubble wrapped sheet being located within the shell, with the foil side of the sheet facing the openings, these openings being aligned with a respective cavity of the sheet.

5. A tamper proof product dispenser according to claim 4, the outlets are also provided in the lower wall, the outlets on each side being for a respective row of the solid dosage product.

6. A tamper proof product dispenser according to claim 2 wherein the upper and lower walls each having said at least one set of outlets, said housing being adapted to accommodate two said sheets therein, each wall associated with an actuating arm and a rider.

7. A tamper proof product dispenser according to claim 6 wherein a plurality of said actuating arms are located within the housing each actuating arm being located in opposed relation to a set of outlets and in use to be associated with a row of said product units accommodated within the housing, each actuating arm slidably supporting a rider.

8. A tamper proof product dispenser according to claim 7, wherein the actuating arm is are slidably supported by an inner support frame located within the housing.

9. A tamper proof product dispenser according to claim 1, a plurality of the slide mechanisms each having an actuation arm are located within the dispensing assembly, each said actuation arm being located adjacent an associated row of solid dosage product accommodated in the dispensing assembly.

10. A tamper proof product dispenser according to claim 9, the actuation arms are slidably supported by a support frame located within the dispensing assembly.

11. A tamper proof product dispenser according to claim 1, an abutment extends from the rider member, whereby the motion of the actuation arm moves the rider member and urges the abutment of the rider membrane against a said solid dosage product so that product can be ejected out of the dispensing assembly to thereby dispense that product therefrom.

12. A tamper proof product dispenser according to claim 11, the ejection means further includes a first ratchet mechanism between the actuating arm and the slider limiting the motion of the rider member relative to the slider to the other direction only.

13. A tamper proof product dispenser according to claim 12, the first ratchet mechanism includes a plurality of flexible fingers extending from the actuation arm, each said flexible finger extending at an acute angle from the plane of the actuation arm and all pointing towards the forward direction of the actuation arm, the rider member being movable in the forward direction over the top of each finger, with each finger acting to push the rider member along the actuation arm.

14. A tamper proof product dispenser according to claim 13, a second ratchet mechanism in the form of flexible ratchet fingers are provided on a side guide wall of the support frame adjacent the or each actuation arm, the ratchet fingers extending at an acute angle from the plane of the side guide wall and engaging the rider to limit the motion of the rider within the housing to the one direction of the actuation arm.

15. A tamper proof product dispenser according to claim 1, a resiliently supported wedge shaped intermediate abutment member is located adjacent each solid dosage product, whereby the motion of the actuation arm moves the rider member against an intermediate abutment member such that said solid dosage product is urged by the intermediate member and ejected out of the dispensing assembly to thereby dispense the product therefrom.

16. A tamper proof product dispenser according to claim 1, each actuation arm includes a finger rest on one end thereof, the finger rest being located in an exposed surface on the outside of the dispensing assembly, such that the actuation arm can be moved by applying a force on the finger rest.

17. A tamper proof product dispenser according to claim 16, a removable spacer is provided between the finger rest and a shoulder on the dispensing assembly, the spacer preventing motion of the actuation arm until the spacer is removed from between the finger rest and the shoulder.

18. A tamper proof product dispenser according to claim 1, the outer cover is slidably supported over the dispensing assembly, and the tamper indication means prevents sliding motion of the cover over the dispensing assembly which will allow access to the product located therein.

19. A tamper proof product dispenser according to claim 18, further comprising a childproofing means for preventing a child from readily removing the cover, the child proofing means includes a button mounted on the end of a tongue, the other end of the tongue being hingedly connected to the rest of the dispensing assembly, and means for engaging the outer cover.

20. A tamper proof product dispenser according to claim 19, the engagement means is in the form of a male lug provided on an inner surface of the outer cover, with a cooperating aperture or cavity being provided in the tongue, the lug being captured within the aperture or cavity in the tongue when the cover is closed over the dispensing assembly, such that pivotal displacement of the tongue away from the lug by applying a lateral force on the button releases the aperture or cavity of the tongue from the lug thereby allowing movement of the cover over the dispensing assembly.

21. A tamper proof product dispenser according to claim 20, a portion of the tamper indication means is located under an edge of the button to prevent movement thereof until such times as the tamper indication means is separated from the outer cover.

22. A tamper proof product dispenser according to claim 18, the tamper indication means is in the form of a removable part of the outer cover, the removable part being coupled to or partially secured to the dispensing assembly, the separation of the removable part releasing the outer cover from the dispensing assembly allowing relative movement therebetween as well as providing a visual indication that the dispenser has been opened.

23. A tamper proof product dispenser according to claim 22, the removable part is in the form of an elongate tag, at least a portion of the opposing sides of the tag being secured to the outer cover, the tag being secured to the outer cover by a frangible membrane.

24. A tamper proof product dispenser according to claim 23, the tag is formed integrally with the outer cover.

25. A tamper proof product dispenser according to claim 23, wherein one end of the elongate tag is provided with a raised ledge that is positioned away from an outer surface of the outer cover, the ledge providing a means whereby a person can lift the end of the tag away from the rest of the dispenser to thereby separate the rest of the tag therefrom, the opposing end of the elongate tag being coupled to the dispending assembly and being uncoupled therefrom when the elongate tag is removed from the dispenser.

26. A tamper proof product dispenser according to claim 25, the opposing end of the elongate tag is located under an undercut provided on the dispensing assembly when coupled thereto.

27. A tamper proof product dispenser according to claim 1, further including child proofing means for preventing a child from readily moving the cover thereby preventing access to the product contained therein.

28. A tamper proof product dispenser according to claim 1, the outer cover is hingedly supported adjacent one end thereof on the dispensing assembly, the tamper indication means preventing pivotable motion of the outer cover away from the dispensing assembly which would allow access to the product located therein.

29. A tamper proof product dispenser according claims 28, wherein the cover (101) is hingedly connected to the housing adjacent one end of the housing (3), said one end of the cover being further interconnected by a coupling arrangement to the actuating arm (59) of the ejection means of the dispensing assembly such that pivotal movement of the cover (101) away from the housing will result in the displacement of the actuating arm (59) in the first direction, and such that the return of the cover (101) back to its initial position against the housing (3) results in the actuating arm (59) being refracted back to its initial position.

30. A tamper proof product dispenser according to claim 28, the outer cover is hingeably connected adjacent one end of the outer cover, said one end of the cover being further interconnected by a coupling arrangement to the actuation arm of the ejection means of the dispensing assembly such that the pivotable movement of the outer cover away from the dispenser assembly will result in the displacement of the actuation arm in the forward direction, and such that the return of the outer cover back to its initial position against the dispensing assembly results in the actuation arm being retracted back to its initial position prior to actuation thereof.

31. A tamper proof product dispenser according to claim 30, the coupling arrangement includes at least one pivot pin engaged to a cooperating slot arrangement, the pivot pin being supported on and adjacent the one end of the outer cover, the pivot pin having a pivot axis extending at least substantially parallel to the pivot axis of the outer cover, the cooperating slot arrangement being provided on a rear end of the actuation arm.

32. A tamper proof product dispenser according to claim 30, wherein the coupling arrangement includes at least one pivot pin (107) engaged to a cooperating slot arrangement (108), the pivot pin (1-7) being supported on and adjacent the one end of the cover (101), the pivot pin (107) having a pivot axis extending at least substantially parallel to the pivot axis of the cover, the cooperating slot arrangement (108) being provided on a rear end of the actuating arm.

33. A tamper proof product dispenser according to claim 28, the tamper indication means is in the form of a removable part of the outer cover, the separation of the removable part therefrom enabling the outer cover to be pivotally displaced away from the dispensing assembly.

34. A tamper proof product dispenser according to claim 33, further including a child proofing means for preventing a child from readily moving the outer cover thereby preventing access to the product contained therein.

35. A tamper proof product dispenser according to claim 34 wherein the child proofing means includes an engagement means (115) for retaining the cover (101) over the outlets (37).

36. A tamper proof product dispenser according to claim 34, the child proofing means includes an engagement means for engaging the outer cover to the dispensing assembly.

37. A tamper proof product dispenser according to claim 36, wherein the engagement means (115) includes at least one tag ((124) extending from an inner face of the cover (101).

38. A tamper proof product dispenser according to claim 36, the engagement means includes one or more tags extending from an inner face of the cover, said tag(s) forming part of a coupling arrangement for engaging the outer cover of the dispensing assembly.

39. A tamper proof product dispenser according to claim 38, wherein the coupling arrangement includes an aperture (125) provided in the at least one tag (124) for engaging at least one cooperating lug (123) provided within the housing (3), the at least one cooperating lug (123) being supported from a manual actuator (119) which is supported from the housing (3) and is resiliently biased to a looked position at which position the at least one cooperating lug (123) engages the at least one tag (124) and (new) the release of the at least one tag (124)_from the at least one cooperating lug (123) with resilient displacement of the manual actuator (119) allows the pivotal movement of the cover (101).

40. A tamper proof product dispenser according to claim 38, the coupling arrangement includes an aperture provided in the tag(s) for engaging a cooperating lug provided within the dispensing assembly, the lug(s) being resiliently biased and supported on a manual actuator mechanism for allowing the release of the lug(s) from the cooperating tag thereby allowing the pivotal movement of the outer cover from the dispenser assembly.

41. A tamper proof product dispenser according to claim 40, wherein the removable part of the tamper indication means (117) is provided on the cover, the removable part when present preventing movement of the manual actuator (119) from the locked position.

42. A tamper proof product dispenser according to claim 40, the manual actuator mechanism includes a biased latch, whereby movement of the latch disengages the coupling arrangement.

43. A tamper proof product dispenser according to claim 42, the locking element of the tamper indication means is provided on the outer cover, the locking element preventing movement of the latch thereby preventing the release of the cover from the dispensing assembly.

44. A tamper proof product dispenser according to claim 43, wherein the removable part includes a locking tab located immediately adjacent the manual actuator, the locking tab being connected to the cover by a frangible connection (118).

45. A tamper proof product dispenser according to claim 43, the locking element includes a locking tab located immediately adjacent the latch, the locking tab being connected to the outer cover by a frangible connection.

46. A tamper proof product dispenser according to claim 45, wherein the locking tab is integrally formed with the cover with a relatively thin wall section (118) between the locking tab and the rest of the cover to provide the frangible connection.

47. A tamper proof product dispenser according to claim 45, the locking tab is integrally formed with the outer cover with a relatively thin wall section between the locking tab and the rest of the outer cover to provide frangible connection portion for the locking tab.

48. A tamper proof dispenser for a solid dosage product the solid dosage product is in the form of a plurality of discrete product units arranged in at least one elongate row at spaced intervals along the at least one row, the dispenser comprising housing and a cover, the housing having an upper and a lower wall, the upper wall formed with at least one set of the outlets in the upper wall for dispensing the product, said the outlets arranged in correspondence to the in correspondence with the product units to be accommodated within the housing; the cover adapted for covering at least the upper wall to thereby prevent access to the outlets, and tamper indication means for indicating a prior displacement of the cover, the dispenser further comprising at least one actuating arm accommodated between the upper and lower wall and associated with one of the at least one row of outlets to be located to the opposite side of the product units to the wall, said actuating arm being slidable accommodated within the housing for reciprocating movement in a direction parallel to the elongate row of outlets, the actuating arm slidably supporting a rider member, the rider member being capable of slidable movement along the actuating arm, a first interconnection between the rider and the actuating arm to permit movement of the rider in one direction along the actuating arm, the rider in part supported within the housing through a second interconnection which is adapted to permit movement of the rider within the housing in one direction only whereby on longitudinal movement of the actuating arm in a first direction the rider is moved through the housing by the actuating arm and on movement of the actuating arm in the opposite direction the rider is held stationary within the housing, the degree of movement of the actuating arm within the housing being substantially limited to the spacing between product units, the rider adapted to sequentially bear upon each product unit with each movement of the actuating arm in the first direction to push a product unit from within the housing through the respective outlet, the actuating arm being associated with a member operable from outside of the dispensing assembly to reciprocally actuate said actuating arm.

49. A tamper proof product dispenser as claimed at claim 48, wherein the housing is adapted to accommodate at least one solid dosage product bubble wrapped sheet, each sheet including a plastic membrane having a plurality of depressions to provide a cavity within which each product unit is respectively located, and a foil covering the plastic membrane to thereby seal the product unit therein, said sheet to be supported within the housing such that the foil side of the sheet faces the outlets.

50. A tamper proof product dispenser according to claim 49 wherein the dispenser includes an outer shell for accommodating one or more of the sheets.

51. A tamper proof product dispenser according to claim 48 wherein a plurality of said actuating arms are located within the housing each actuating arm being located in opposed relation to a set of outlets and in use to be associated with a row of said product units accommodated within the housing, each actuating arm slidably supporting a rider.

52. A tamper proof product dispenser according to claim 48, wherein the actuating arm is are slidably supported by an inner support frame located within the housing.

53. A tamper proof product dispenser according to claim 48, wherein an abutment extends from the rider member, the abutment being intended in use to bear upon said product unit on the movement of the rider within the housing.

54. A tamper proof product dispenser according to claim 48 wherein a resiliently supported wedge shaped intermediate abutment member is located adjacent the intended position of each product unit and an abutment extends from the rider member, the abutment being intended in use to engage intermediate abutment member to cause the intermediate abutment member to bear upon said product unit on the movement of the rider within the housing.

55. A tamper proof product dispenser according to claim 48, wherein the first and second interconnection each comprises a first and a second ratchet mechanism respectively.

56. A tamper proof product dispenser according to claim 55, wherein the first ratchet mechanism includes a plurality of spaced flexible first fingers extending from the actuating arm, each first finger extending at an acute angle from the actuating arm and the inclined face of the first fingers being convergent with the actuating arm in the second direction.

57. A tamper proof product dispenser according to claim 56, wherein the second ratchet comprises a set of spaced flexible second fingers supported from the housing adjacent the actuating arm, the second ratchet fingers extending at an acute angle from the housing and the inclined face of the second fingers being convergent with the housing in the first direction.

58. A tamper proof product dispenser according claim 48 wherein the member comprises a finger rest on one end of the actuating arm, the finger rest being located in an exposed position on the outside of the housing, such that the actuating arm can be moved by applying a force to the finger rest.

59. A tamper proof product dispenser according to claim 58, wherein a removable spacer is provided between the finger rest and an opposing shoulder on the housing, the spacer preventing motion of the actuating arm until the spacer is removed from between the finger rest and the shoulder.

60. A tamper proof product dispenser according to claim 48, wherein the cover is slidably supported over the housing, and the tamper indication means prevents sliding motion of the cover over the housing which will allow access to the product located therein.

61. A tamper proof product dispenser according to claim 60, wherein the tamper indication means is in the form of a removable part of the cover, the removable part being coupled to or partially secured to the housing, the separation of the removable part releasing the cover from the dispensing assembly to allow relative movement therebetween as well as providing a visual indication that the dispenser has been opened.

62. A tamper proof product dispenser according to claim 61, wherein the removable part is in the form of an elongate tag, at least a portion of the opposing sides of the tag being secured to the cover, the tag being secured to the cover by a frangible membrane.

63. A tamper proof product dispenser according to claim 62, wherein the tag is formed integrally with the cover.

64. A tamper proof product dispenser according to claim 62, wherein one end of the elongate tag is provided with a raised ledge that is positioned away from an outer surface of the cover, the ledge providing a means whereby a person can lift the end of the tag away from the rest of the dispenser to thereby separate the rest of the tag therefrom, the opposing end of the elongate tag being coupled to the cover and being uncoupled therefrom when the elongate tag is removed from the dispenser.

65. A tamper proof product dispenser according to claim 64, wherein the opposing end of the elongate tag is coupled with the cover to prevent the movement of the cover when coupled thereto.

66. A tamper proof product dispenser according to claim 48, further including child proofing means for preventing a child from readily moving the cover thereby preventing access to the product contained therein.

67. A tamper proof product dispenser according to claim 66, wherein the child proofing means includes a button mounted on the end of a tongue, the other end of the tongue being hingedly coupled to the housing, the tongue engaged with the cover whereby manipulation of the button will release the cover from the tongue to enable it to be moved to provide access to the outlets.

68. A tamper proof product dispenser according to claim 67, wherein the tongue has an aperture or cavity, a male lug provided on an inner surface of the cover and positioned to be received in the aperture or cavity when the cover is positioned to cover the outlets and displacement of the tongue away from the lug by applying a force on the button releases the aperture or cavity from the lug to allow said movement of the cover.

69. A tamper proof product dispenser according to claim 68, wherein the cover is slidably supported over the housing, and the tamper indication means prevents sliding motion of the cover over the housing which will allow access to the product located therein, the tamper indication means is in the form of a removable part of the cover, the removable part being coupled to or partially secured to the housing, the separation of the removable part releasing the cover from the dispensing assembly to allow relative movement therebetween as well as providing a visual indication that the dispenser has been opened, the removable part is in the form of an elongate tag, at least a portion of the opposing sides of the tag being secured to the cover, the tag being secured to the cover by a frangible membrane, the tag is formed integrally with the cover, one end of the elongate tag is provided with a raised ledge that is positioned away from an outer surface of the cover, the ledge providing a means whereby a person can lift the end of the tag away from the rest of the dispenser to thereby separate the rest of the tag therefrom, the opposing end of the elongate tag being coupled to the cover and being uncoupled therefrom when the elongate tag is removed from the dispenser wherein the opposing end of the elongate tag is coupled with the cover to prevent the movement of the cover when coupled thereto and wherein the opposing end of the tamper indication means is located under an edge of the button to prevent movement thereof until the tamper indication means is separated from the cover.

70. A tamper proof product dispenser according to claim 48 wherein the cover is hingedly supported adjacent one end thereof on the housing, the tamper indication means preventing pivotal motion of the cover away from the outlets.

71. A tamper proof product dispenser according to claim 70, wherein the tamper indication means is in the form of a removable part of the cover, the separation of the removable part therefrom enabling the cover to be pivotally displaced away from the outlets.

72. A tamper proof product dispenser according to claim 71, further including a child proofing means for preventing a child from readily moving the cover thereby preventing access to the product contained therein.

* * * * *